US008384606B2

(12) United States Patent
Shoji

(10) Patent No.: US 8,384,606 B2
(45) Date of Patent: Feb. 26, 2013

(54) ANTENNA DEVICE AND COMMUNICATION TERMINAL

(75) Inventor: Hideaki Shoji, Chiba (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 360 days.

(21) Appl. No.: 12/424,862

(22) Filed: Apr. 16, 2009

(65) Prior Publication Data

US 2009/0278755 A1 Nov. 12, 2009

(30) Foreign Application Priority Data

May 12, 2008 (JP) ..... 2008-125172

(51) Int. Cl.
*H01Q 9/00* (2006.01)
*H01Q 1/50* (2006.01)

(52) U.S. Cl. ..... 343/745; 343/860

(58) Field of Classification Search ..... 343/745, 343/860

See application file for complete search history.

(56) References Cited

U.S. PATENT DOCUMENTS

| | | | | |
|---|---|---|---|---|
| 6,034,640 | A * | 3/2000 | Oida et al. | 343/722 |
| 6,873,299 | B2 * | 3/2005 | Dakeya et al. | 343/745 |
| 6,903,688 | B2 * | 6/2005 | Edvardsson | 343/700 MS |
| 7,109,944 | B2 * | 9/2006 | Sato et al. | 343/860 |
| 7,176,841 | B2 * | 2/2007 | Fukuda | 343/745 |
| 7,242,364 | B2 * | 7/2007 | Ranta | 343/860 |
| 7,420,511 | B2 * | 9/2008 | Oshiyama et al. | 343/700 MS |
| 7,940,226 | B2 * | 5/2011 | Tsubaki et al. | 343/745 |
| 2001/0043159 | A1 | 11/2001 | Masuda et al. | |
| 2004/0075614 | A1 * | 4/2004 | Dakeya et al. | 343/745 |
| 2004/0227585 | A1 | 11/2004 | Taniguchi et al. | |
| 2006/0279469 | A1 * | 12/2006 | Adachi et al. | 343/767 |
| 2008/0258984 | A1 * | 10/2008 | Adachi et al. | 343/745 |
| 2009/0115674 | A1 * | 5/2009 | Fujieda et al. | 343/745 |

FOREIGN PATENT DOCUMENTS

| | | | |
|---|---|---|---|
| CN | 1714471 | A | 12/2005 |
| EP | 0 613 209 | A1 | 8/1994 |
| EP | 1 848 061 | A2 | 10/2007 |
| EP | 1 848 061 | A3 | 10/2007 |
| JP | 53-87654 | | 8/1978 |
| JP | 2001-326521 | | 11/2001 |

(Continued)

OTHER PUBLICATIONS

Chinese Office Action issued Mar. 21, 2012, in Patent Application No. 200910140590.7 (with English-language translation).

*Primary Examiner* — Douglas W Owens
*Assistant Examiner* — Jennifer F Hu
(74) *Attorney, Agent, or Firm* — Oblon, Spivak, McClelland, Maier & Neustadt, L.L.P.

(57) ABSTRACT

An antenna device includes: an antenna element that transmits or receives wireless signals in a predetermined first frequency band and in a second frequency band higher in frequency than the first frequency band; a feeding terminal portion; a first bandwidth adjustment circuit that includes a first capacitor for widening a bandwidth of the first frequency band to a predetermined bandwidth, the capacitance of the first capacitor being set at a predetermined value in accordance with the predetermined bandwidth; and a second bandwidth adjustment circuit that includes second and third capacitors and a first inductor for widening a bandwidth of the first frequency band to the predetermined bandwidth, the capacitance of each of the second and third capacitors and the inductance of the first inductor being respectively set at predetermined values in accordance with the predetermined bandwidth.

4 Claims, 28 Drawing Sheets

FOREIGN PATENT DOCUMENTS

| | | |
|---|---|---|
| JP | 2005-521315 | 7/2005 |
| JP | 2006-527949 | 12/2006 |
| WO | WO2004/047223 | 6/2004 |
| WO | WO 2007/145114 A1 | 12/2007 |

* cited by examiner

LOW-FREQUENCY BAND

HIGH-FREQUENCY BAND

ANTENNA DEVICE AND COMMUNICATION TERMINAL

BACKGROUND OF THE INVENTION

1. Field of the Invention

The invention relates to an antenna device and a communication terminal and, more particularly, to a single-feeder antenna device with multiband capability and a communication terminal equipped with the antenna device.

2. Description of the Related Art

In recent years, some cellular phones use GSM (Global System for Mobile Communications) as one of wireless communication systems. The available frequency band in the GSM is, for example, 850 MHz band, 900 MHz band, 1800 MHz band, 1900 MHz band, or the like. In addition, other than the GSM, a UMTS (Universal Mobile Telecommunication System) is employed as a wireless communication system, and the available frequency band of the UMTS is 2 GHz band.

In addition, in an existing art, a wireless communication terminal, such as a cellular phone terminal, capable of handling the above described wireless communication systems has been developed. Such a wireless communication terminal is able to handle a plurality of available frequency bands. In addition, various structures of an antenna device component of such a wireless communication terminal are suggested in order to be able to handle a plurality of frequency bands. Examples of the structures are shown in FIG. 33 to FIG. 35.

Antenna device components shown in FIG. 33 to FIG. 35 are single-feeder antenna device components. In addition, the antenna device components shown in FIG. 33 to FIG. 35 are able to handle 850 MHz band or 900 MHz band in the GSM in a low-frequency band, and are able to handle 1800 MHz band and 1900 MHz band in the GSM and 2 GHz band in the UMTS in a high-frequency band.

The antenna device component 110 shown in FIG. 33 is an antenna device component with a short-circuit parasitic element (see, for example, Translation of PCT Application No. 2006-527949). As shown in FIG. 33, an antenna element 2 of the antenna device component 110 includes a low-frequency band antenna conductor 72 and two high-frequency band antenna conductors 73 and 74. The high-frequency band antenna conductor 74 is formed along the outer side of the other high-frequency band antenna conductor 73, and is not electrically connected to the high-frequency band antenna conductor 73. The antenna device component 110 uses capacitive coupling of the high-frequency band antenna conductor 73 with the other high-frequency band antenna conductor 74 to enable handling a plurality of high-frequency band modes. Note that where the wavelength of a signal in each available frequency band is $\lambda$, the path length of each conductor is adjusted to $\lambda/4$.

In addition, the antenna device component 111 shown in FIG. 34 is a GF slot-type (type in which a slot is present between a ground portion (Ground) and a feed (Feed) connecting portion) antenna device component. As shown in FIG. 34, an antenna element 2 of the antenna device component 111 includes a low-frequency band antenna conductor 92 and two high-frequency band antenna conductors 93 and 94. In the antenna device 111, these antenna conductors are electrically connected to each other. Then, in the antenna device component 111, the path length of each antenna conductor is varied to handle a plurality of frequencies.

The antenna device component 81 shown in FIG. 35 is a bifurcated element-type antenna device component that performs matching by a parallel resonant circuit 39. As shown in FIG. 35, an antenna element 2 of the antenna device component 81 includes two antenna conductors 35 and 36 and the parallel resonant circuit 39 in which an inductor 37 and a capacitor 38 are connected in parallel. One of the terminals of the parallel resonant circuit 39 is connected to a feed line 11 that connects a feeding point 3 with the antenna conductors 35 and 36, and the other terminal is grounded by a short-circuit line 10.

In the antenna device component 81 shown in FIG. 35, the parallel resonant circuit 39 formed of the inductor 37 and the capacitor 38 is provided to handle a plurality of high-frequency band modes. Specifically, the parallel resonant circuit 39 is designed so that only the inductor 37 of the parallel resonant circuit 39 substantially functions in the high-frequency band mode having a frequency of the lower one. In addition, the parallel resonant circuit 39 is designed so that only the capacitor 38 of the parallel resonant circuit 39 substantially functions in the high-frequency band mode having a frequency of the higher one.

The frequency characteristics of the antenna device components shown in FIG. 33 to FIG. 35 each include a low-frequency band and a high-frequency band. The high-frequency band is formed of three modes, that is, 1800 MHz, 1900 MHz and 2 GHz, so the high-frequency band has a wide-band characteristic. On the other hand, the low-frequency band is formed of a single mode, that is, 850 MHz (or 900 MHz), so the low-frequency band has a narrow-band characteristic.

In addition, in an existing art, it has been suggested that various antenna device components are also able to handle a plurality of frequency bands in a low-frequency band (see, for example, Translation of PCT Application No. 2005-521315, Domestic Re-publication of PCT Application 2004-047223 and "A Brief Survey of Internal antennas in GSM phone 1998 to 2005" (Corbett Roewll, Hong Kong)).

Translation of PCT Application No. 2005-521315 suggests a dielectric-resonator antenna device component. The antenna device component uses a high-dielectric material to have two-resonance characteristics in a low-frequency band, thus obtaining a wide-band characteristic.

Domestic Re-publication of PCT Application No. 2004-047223 suggests an antenna device component called a tunable antenna. The antenna device component includes a frequency band change-over switch. With the change-over switch, the antenna device component handles two modes in a low-frequency band.

In addition, "A Brief Survey of Internal antennas in GSM phone 1998 to 2005" (Corbett Roewll, Hong Kong) suggests a stacked antenna device component. The antenna device component bonds two antenna conductors to have a double-layer structure, thus obtaining a wide-band characteristic in a low-frequency band.

SUMMARY OF THE INVENTION

The above described Translation of PCT Application No. 2005-521315, Domestic Re-publication of PCT Application 2004-047223, and "A Brief Survey of Internal antennas in GSM phone 1998 to 2005" (Corbett Roewll, Hong Kong) suggest various antenna device components that are able to handle a plurality of low-frequency bands. However, there is a problem that any of these antenna device components have a complex structure.

In addition, the antenna device suggested in Translation of PCT Application No. 2005-521315 uses an expensive high-dielectric material and, therefore, there is a problem that the cost increases. Moreover, because the structure is complex, there is another problem that the design is complex.

In addition, the antenna device suggested in Domestic Re-publication of PCT Application No. 2004-047223 includes a change-over switch for switching frequency bands, resulting in problematically high cost and high power consumption. Moreover, a distortion may occur in a high-frequency signal because of the change-over switch.

Furthermore, the antenna device suggested in "A Brief Survey of Internal antennas in GSM phone 1998 to 2005" (Corbett Roewll, Hong Kong) has a structure such that two antenna conductors are bonded with each other. This calls for bonding accuracy and, therefore, there is a problem in mass productivity.

As described above, there is also a problem that the antenna device components suggested in Translation of PCT Application No. 2005-521315, Domestic Re-publication of PCT Application No. 2004-047223 and "A Brief Survey of Internal antennas in GSM phone 1998 to 2005" (Corbett Roewll, Hong Kong) each have a complex structure, and provide high cost and low mass productivity.

Then, even in the relatively simply structured antenna device components having a single resonance mode in a low-frequency band as shown in FIG. 33 to FIG. 35, it is desired to handle both 850 MHz band and 900 MHz band. In addition, because of restrictions on design, these antenna device components may be generally mounted at positions at which the antenna device components are easily influenced by a user (for example, electromagnetic waves are absorbed by a human body to decrease the radiation efficiency). In terms of such influence of the user as well, it is desirable to widen an available low-frequency band in the antenna device components shown in FIG. 33 to FIG. 35.

Methods for widening the available low-frequency band in the antenna device components shown in FIG. 33 to FIG. 35 may be, for example, the length of a ground conductor, which serves as a GND (Ground), in the antenna device component is elongated or the volume of the antenna element is increased. However, these methods are subjected to physical limits due to, for example, a request for miniaturization of a communication terminal.

In addition, the structure, design approach, and the like, of the antenna device components described in Translation of PCT Application No. 2005-521315, Domestic Re-publication of PCT Application No. 2004-047223 and "A Brief Survey of Internal antennas in GSM phone 1998 to 2005" (Corbett Roewll, Hong Kong) are basically different from those of the antenna device components shown in FIG. 33 to FIG. 35. For this reason, it is technically difficult to apply the techniques described in Translation of PCT Application No. 2005-521315, Domestic Re-publication of PCT Application No. 2004-047223 and "A Brief Survey of Internal antennas in GSM phone 1998 to 2005" (Corbett Roewll, Hong Kong) to the antenna device components shown in FIG. 33 to FIG. 35.

It is desirable to provide a single-feeder antenna device that has a further simple structure and that is able to handle a plurality of low-frequency bands, and a communication terminal equipped with the antenna device.

According to an embodiment of the invention, an antenna device includes: an antenna element that transmits or receives wireless signals in a predetermined first frequency band and in a second frequency band that is higher in frequency than the first frequency band; and a feeding terminal portion. In addition, according to the embodiment of the invention, the antenna device includes first and second bandwidth adjustment circuits for widening a bandwidth of the first frequency band to a predetermined bandwidth. In addition, the first bandwidth adjustment circuit includes a first capacitor, one of terminals of the first capacitor is connected to the antenna element, and the other terminal is grounded. Note that the capacitance of the first capacitor is set at a predetermined value in accordance with the predetermined bandwidth of the first frequency band, and the capacitance of the first capacitor is set at the predetermined value so that the first capacitor is placed in a substantially short-circuit state for signals in the second frequency band. In addition, the second bandwidth adjustment circuit includes a second capacitor, a third capacitor and a first inductor. Then, in the second bandwidth adjustment circuit, one of terminals of the second capacitor is connected to the antenna element and the other terminal is connected to the feeding terminal portion. In addition, in the second bandwidth adjustment circuit, the third capacitor and the first inductor are connected in series to form a first resonant circuit, and one of terminals of the first resonant circuit is connected to the feeding terminal portion and the other terminal is grounded. Note that the capacitance of each of the second and third capacitors and the inductance of the first inductor are respectively set at predetermined values in accordance with the predetermined bandwidth of the first frequency band. In addition, the capacitance of the second capacitor is set at the predetermined value so that the second capacitor is placed in a substantially short-circuit state for signals in the second frequency band. Furthermore, the capacitance of the third capacitor and the inductance of the first inductor are respectively set at the predetermined values so that the first resonant circuit is placed in a substantially open state for signals in the second frequency band.

Note that the phrase "substantially short-circuit state" in the specification means not only the case where the reactance of a circuit is 0, but also the case where the reactance of a circuit is small and may be ignored, and may be regarded that the circuit is substantially placed in a state equivalent to a short-circuit state. In addition, the phrase "substantially open state" in the specification means not only the case where a circuit is completely placed in an open state, but also the reactance of a circuit is extremely large and may be regarded that the circuit is substantially placed in a state equivalent to an open state.

In the antenna device according to the embodiment of the invention, by appropriately adjusting the reactance of each of the first to third capacitors and first inductor, the bandwidth of the first frequency band is widened to a desired bandwidth. The design principles will be described in detail later.

In addition, the capacitance of each of the first and second capacitors is set so that the first and second capacitors are placed in a substantially short-circuit state for signals in the second frequency band. Furthermore, the capacitance of the third capacitor and the reactance of the first inductor are set so that the first resonant circuit of the second bandwidth adjustment circuit is placed in a substantially open state for signals in the second frequency band. Thus, when signals at a frequency in the second frequency band are input to the antenna device component, the configuration of the antenna device is substantially the same as the configuration that the antenna element is directly grounded by the short-circuit line and is directly connected to the feeding terminal portion by the feed line. That is, the configuration of the antenna device according to the embodiment of the invention has substantially the same configuration as the existing antenna device (for example, antenna devices shown in FIG. 33 to FIG. 35) for signals at a frequency in the second frequency band. As a result, the frequency characteristics of the antenna device in the second frequency band according to the embodiment of the invention are substantially similar to that of the existing art, and favorable characteristics are maintained.

Thus, with the antenna device according to the embodiment of the invention, by appropriately setting the capacitance of each of the first to third capacitors and the reactance of the first inductor, it is possible to widen the bandwidth of the first frequency band to a predetermined width while maintaining the characteristics of the antenna device in the second frequency band at the favorable characteristics similar to those of the existing art.

In addition, according to another embodiment of the invention, a communication terminal includes: an antenna element that transmits or receives wireless signals in a predetermined first frequency band and in a second frequency band that is higher in frequency than the first frequency band; and a feeding terminal portion. In addition, according to the embodiment of the invention, the communication terminal includes first and second bandwidth adjustment circuits for widening a bandwidth of the first frequency band to a predetermined bandwidth. Furthermore, according to the embodiment of the invention, the communication terminal includes a communication circuit that modulates or demodulates the wireless signals transmitted from or received by the antenna element.

That is, the communication terminal according to the embodiment of the invention includes the above described antenna device according to the embodiment of the invention. Thus, with the communication terminal according to the embodiment of the invention, it is possible to provide a communication terminal that has the wide first frequency band (low-frequency side band) while maintaining favorable characteristics of the second frequency band (high-frequency side band).

DESCRIPTION OF THE PREFERRED EMBODIMENTS

Hereinafter, examples of embodiments of the invention will be specifically described with reference to the accompanying drawings; however, embodiments of the invention are not limited to the following embodiments.

First Embodiment

A communication terminal according to a first embodiment of the invention and an antenna device component (antenna device) included in the communication terminal will be described with reference to FIG. 1 to FIG. 25B.

Configuration of Communication Terminal

Figure 1:
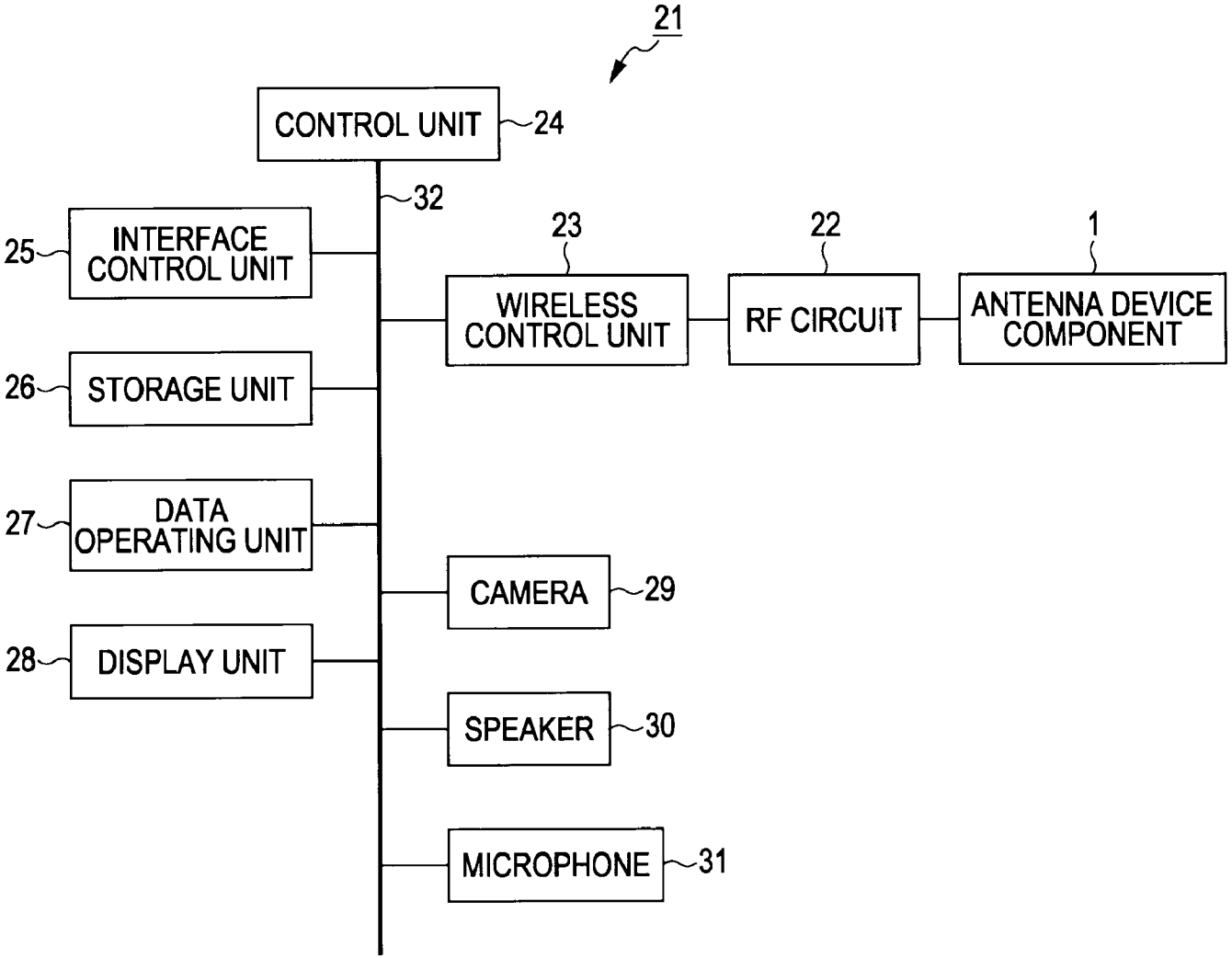
FIG. 1 is a block configuration diagram of a mobile communication terminal according to a first embodiment of the invention.

First, the configuration of the communication terminal according to the present embodiment will be described. Note that in the description of the present embodiment, a mobile communication terminal is used as the communication terminal as an example. However, the mobile communication terminal is a so-called cellular phone terminal and is a terminal that carries out wireless communication with a base station for wireless telephones. FIG. 1 shows the block configuration diagram of the mobile communication terminal equipped with the antenna device component 1 according to the present embodiment.

As shown in FIG. 1, the mobile communication terminal 21 includes the antenna device component 1, an RF (Radio Frequency) circuit 22 (communication circuit) connected to the antenna device component 1, and a wireless control unit 23 connected to the RF circuit 22. In addition, the mobile communication terminal 21 includes a control unit 24, an interface control unit 25, a storage unit 26, a data operating unit 27, and a display unit 28. Furthermore, the mobile communication terminal 21 includes a camera 29, a speaker 30, and a microphone 31. The camera 29 is able to take a photograph of a dynamic image and a static image. The speaker 30 is used to output audio during a telephone conversation. The microphone 31 is used to pick up audio during a telephone conversation.

In addition, as shown in FIG. 1, the mobile communication terminal 21 includes a control line 32. The control line 32 is a signal line through which signals for controlling various units connected thereto. As shown in FIG. 1, the various units of the mobile communication terminal 21 are connected to the control unit 24 via the control line 32, and operations of the various units are controlled by the control unit 24. Although not shown in FIG. 1, the mobile communication terminal 21 includes a power supply unit, from which electric power is supplied to the various units.

The RF circuit 22 is a circuit that modulates or demodulates wireless signals transmitted from or received by the antenna device component 1. Then, the wireless control unit 23 controls modulation/demodulation process of wireless signals in the RF circuit 22.

The control unit 24 is, for example, formed of an arithmetic and control unit, such as a CPU (Central Processing Unit), and controls the various units that constitute the mobile communication terminal 21. In addition, the interface control unit 25 controls data transmission with an external device.

The storage unit 26 is formed of a non-volatile memory, such as a flash memory (semiconductor memory). The storage unit 26 stores various data, such as a telephone book, a schedule, a mail message, a dynamic image, a static image, music, application software, a bookmark, and a web page, and computer programs.

The data operating unit 27 is formed of a jog dial, a keypad, or the like. The data operating unit 27 may be used to input a telephone number, a mail message, or the like, or input an input operation signal, such as an operation of setting various modes. In addition, the display unit 28 is formed of a liquid crystal display (LCD), or the like.

Configuration of Antenna Device Component

Figure 2:
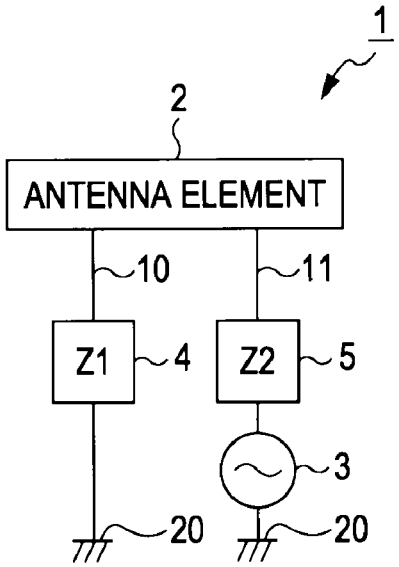
FIG. 2 is a schematic configuration diagram of an antenna device component according to the first embodiment.

Next, the configuration of the antenna device component 1 according to the present embodiment will be described. The antenna device component 1 of the present embodiment is a single-feeder antenna device component with multiband capability, and the configuration of the antenna device component 1 is shown in FIG. 2. As shown in FIG. 2, the antenna device component 1 includes an antenna element 2, a feeding terminal portion 3 (hereinafter, also referred to as feeding point 3), a first bandwidth adjustment circuit 4, and a second bandwidth adjustment circuit 5.

The first bandwidth adjustment circuit 4 and the second bandwidth adjustment circuit 5 are circuits for widening the bandwidth of a low-frequency band (first frequency band) to a predetermined bandwidth, as will be described later. As shown in FIG. 2, the first bandwidth adjustment circuit 4 is provided in midway of a short-circuit line 10 that connects the antenna element 2 to a ground point 20. In addition, the second bandwidth adjustment circuit 5 is provided in midway of a feed line 11 that connects the antenna element 2 to the feeding point 3. Note that the feed line 11 is formed of a 50-ohm strip line.

Figure 3:
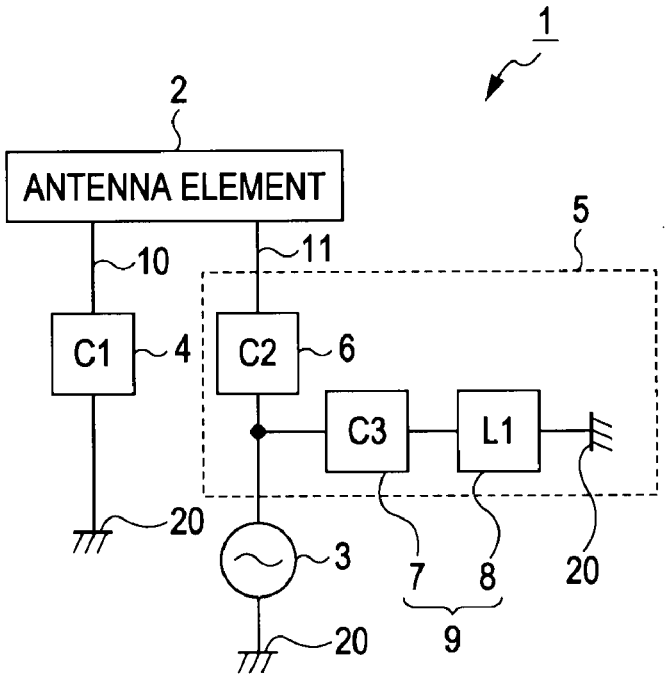
FIG. 3 is a schematic configuration diagram of the antenna device component according to the first embodiment.

The detailed configuration diagram of the antenna device component 1 is shown in FIG. 3. In the present embodiment, as shown in FIG. 3, the first bandwidth adjustment circuit 4 is formed of a capacitor (hereinafter, also referred to as a first capacitor 4) having a capacitance of C1. In addition, one of the terminals of the first capacitor 4 is connected to the antenna element 2, and the other terminal is grounded.

In addition, in the present embodiment, as shown in FIG. 3, the second bandwidth adjustment circuit 5 is formed of a capacitor 6 (hereinafter, also referred to as a second capacitor 6) having a capacitance of C2, a capacitor 7 (hereinafter, also referred to as a third capacitor 7) having a capacitance of C3, and an inductor 8 (hereinafter, also referred to as a first inductor 8) having an inductance of L1. In addition, in the second bandwidth adjustment circuit 5, the third capacitor 7 is connected in series with the first inductor 8 to form a series resonant circuit 9 (first resonant circuit).

In addition, in the second bandwidth adjustment circuit 5, as shown in FIG. 3, one of the terminals of the second capacitor 6 is connected to the antenna element 2, and the other terminal is connected to the feeding point 3. In addition, one of the terminals of the series resonant circuit 9 is connected to the feed line 11 that connects the second capacitor 6 to the feeding point 3, and the other terminal is grounded. That is, in the present embodiment, the series resonant circuit 9 is provided at a position closer to the feeding point 3 than the second capacitor 6.

Note that the capacitance C1 of the first capacitor 4, the capacitance C2 of the second capacitor 6, the capacitance C3 of the third capacitor 7 and the inductance L1 of the first inductor 8 are appropriately set in accordance with the desired frequency characteristics of the antenna device component 1. Specifically, the capacitance C1 of the first capacitor 4, the capacitance C2 of the second capacitor 6, the capacitance C3 of the third capacitor 7 and the inductance L1 of the first inductor 8 are set so as to satisfy all the following qualitative conditions (1) to (3). Note that the design principles will be described later.

(1) The capacitance C1 of the first capacitor 4, the capacitance C2 of the second capacitor 6, the capacitance C3 of the third capacitor 7 and the inductance L1 of the first inductor 8 are set in accordance with the desired bandwidth of the low-frequency band (first frequency band).

(2) The capacitance C1 of the first capacitor 4 and the capacitance C2 of the second capacitor 6 are set so that the first capacitor 4 and the second capacitor 6 are placed in a substantially short-circuit state for signals in a high-frequency band (second frequency band).

(3) The capacitance C3 of the third capacitor 7 and the inductance L1 of the first inductor 8 are set so that the series resonant circuit 9 of the bandwidth adjustment circuit 5 is placed in a substantially open state for signals in a high-frequency band.

Note that the ground point 20 of the antenna device component 1 is connected to a ground point of a circuit substrate (not shown) of the mobile communication terminal 21 via a leaf sprint, or the like. In addition, the feeding point 3 of the antenna device component 1 is connected via a leaf spring, or the like, to a 50-ohm strip line (not shown), which extends from the RF circuit 22 via a switch.

Next, a specific example of the antenna device component of the present embodiment will be described. In this specific example, the configuration of the antenna device component of the present embodiment is applied to the antenna device component (bifurcated element-type antenna device component that performs matching by a parallel resonant circuit) shown in FIG. 35 as an example. Note that in this example, the antenna device component is able to handle 850 MHz band and 900 MHz band in the GSM in a low-frequency band, and is able to handle 1800 MHz band and 1900 MHz band in the GSM and 2 GHz band in the UMTS in a high-frequency band.

Figure 4:
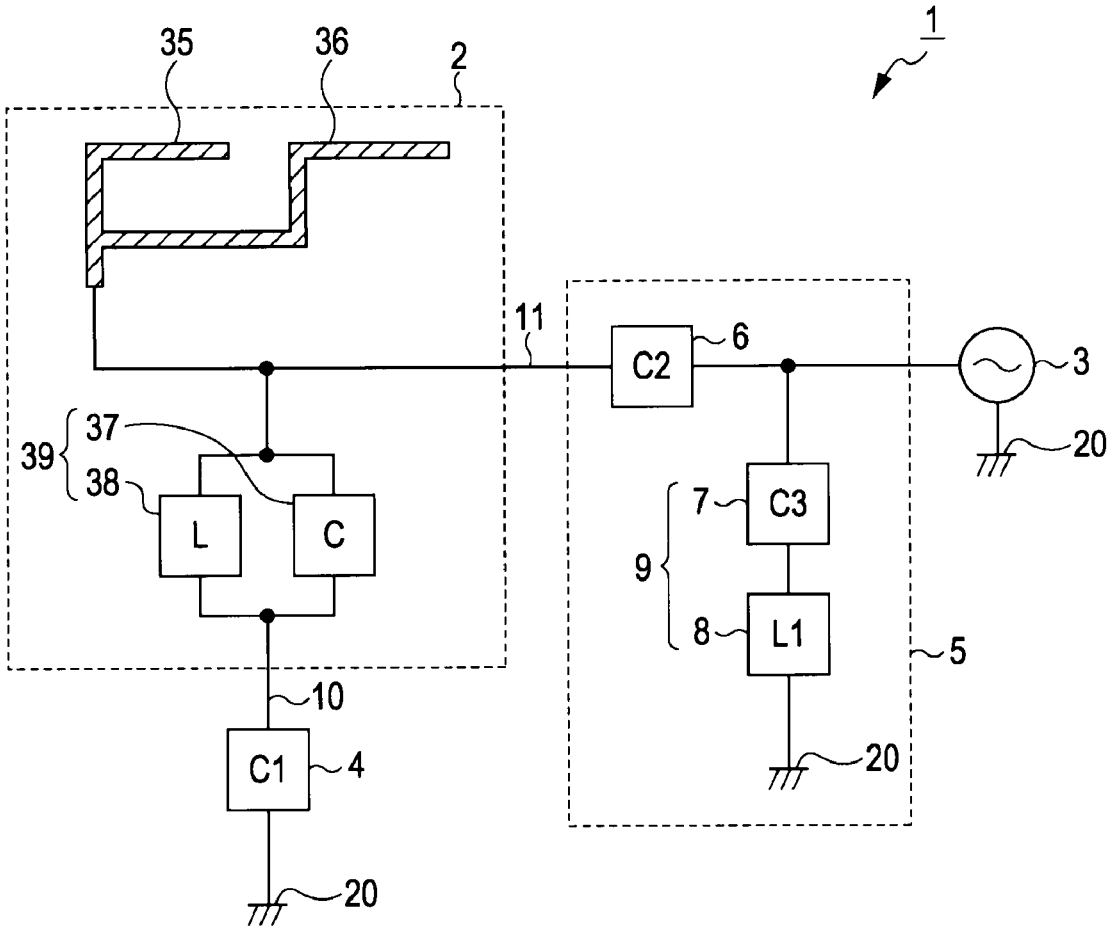
FIG. 4 is a schematic configuration diagram of the antenna device component according to the first embodiment.

The schematic configuration of the antenna device component 1 in this example is shown in FIG. 4. In addition, in the antenna device component 1 of this example, the capacitance C1 of the first capacitor 4 is 20 pF, and the capacitance C2 of the second capacitor 6 is 27 pF. In addition, the capacitance C3 of the third capacitor 7 is 2 pF, and the inductance L1 of the first inductor 8 is 10 nH.

In addition, as shown in FIG. 4, the antenna element 2 used in this example includes two antenna conductors 35 and 36 and a resonant circuit 39 in which an inductor 37 and a capacitor 38 are connected in parallel.

The antenna conductors 35 and 36 are connected to the second capacitor 6 of the second bandwidth adjustment circuit 5 by the feed line 11. Then, one of the terminals of the parallel resonant circuit 39 is connected to the feed line 11 that connects the antenna conductors 35 and 36 to the second capacitor 6, and the other terminal is connected to the first capacitor 4.

Note that the antenna device component 1 shown in FIG. 4 is able to handle a plurality of high-frequency band modes with the parallel resonant circuit 39 formed of the inductor 37 and the capacitor 38. More specifically, the parallel resonant circuit 39 is designed so that only the inductor 37 of the parallel resonant circuit 39 substantially functions in the high-frequency band mode having a frequency of the lower one, and only the capacitor 38 of the parallel resonant circuit 39 substantially functions in the high-frequency band mode having a frequency of the higher one.

Figure 33:
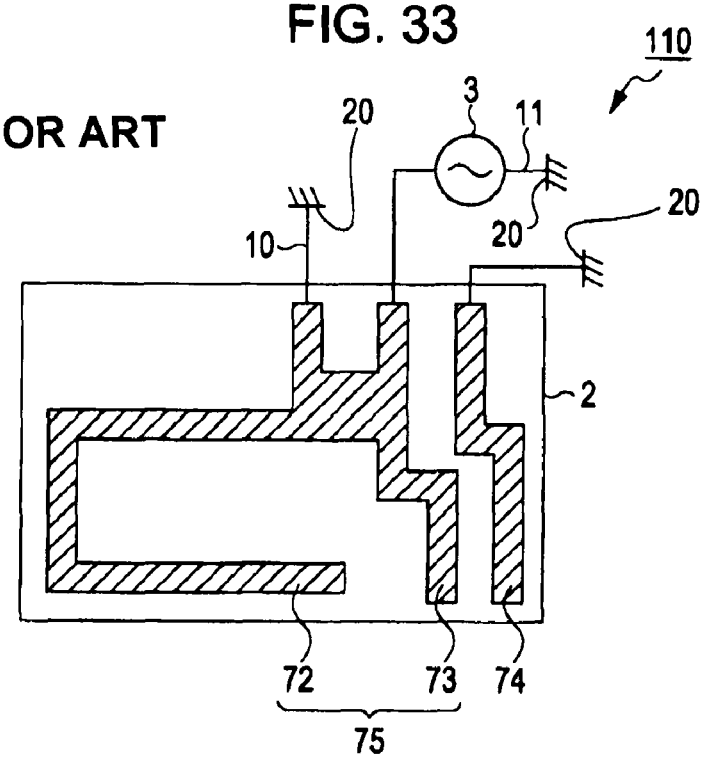
FIG. 33 PRIOR ART
FIG. 33 is a schematic configuration diagram of an antenna device component according to an existing art.
Figure 34:
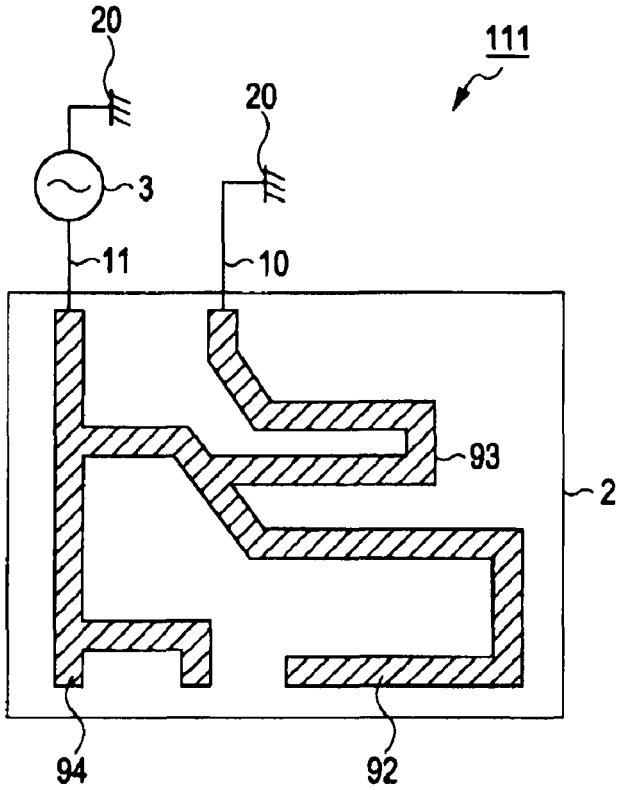
FIG. 34 PRIOR ART
FIG. 34 is a schematic configuration diagram of an antenna device component according to an existing art.
Figure 35:
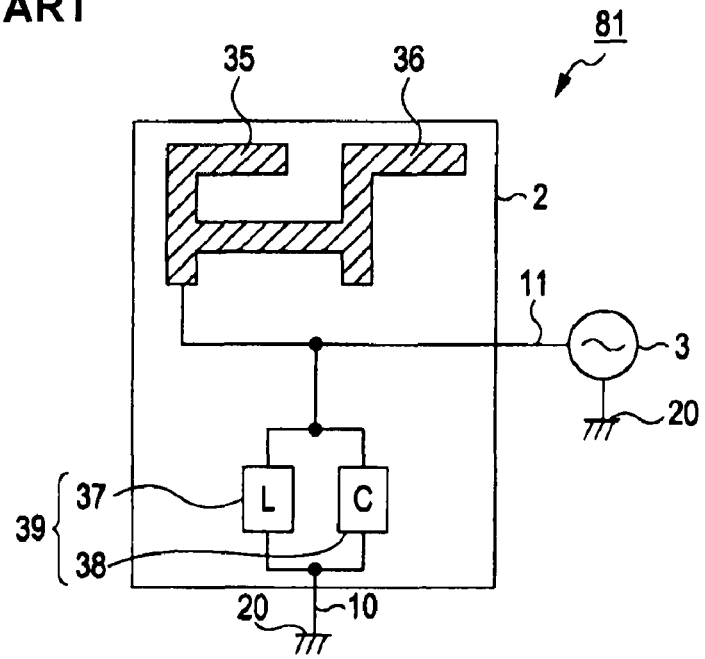
FIG. 35 PRIOR ART
FIG. 35 is a schematic configuration diagram of an antenna device component according to an existing art.

In addition, in the antenna element 2 of this example, the path length of the antenna conductor 36 is designed so that a low-frequency band resonant mode uses 850 MHz band in the GSM. This is because the following reason. The antenna device component according to the embodiment of the invention is able to widen the low-frequency band toward a high-frequency side, as will be described later. Thus, when the embodiment of the invention is applied to the antenna device components that are compliant with a single frequency mode as shown in FIG. 33 to FIG. 35, it is desirable that the low-frequency band resonant mode of the antenna element is adjusted to the lowest frequency mode among a plurality of low-frequency modes that can be handled by the antenna device component.

Note that when the embodiment of the invention is applied to the antenna device component of which the low-frequency band resonant mode is 900 MHz band in the GSM, it may be necessary to elongate the path length of the antenna conductor by forming a detouring path for the path of the low-frequency band antenna conductor. Methods for forming a detouring path in the path of the antenna conductor may be, for example, adding a slit, a meander line, or a series inductor in the path of the low-frequency band antenna conductor.

Frequency Characteristics

Figure 5:
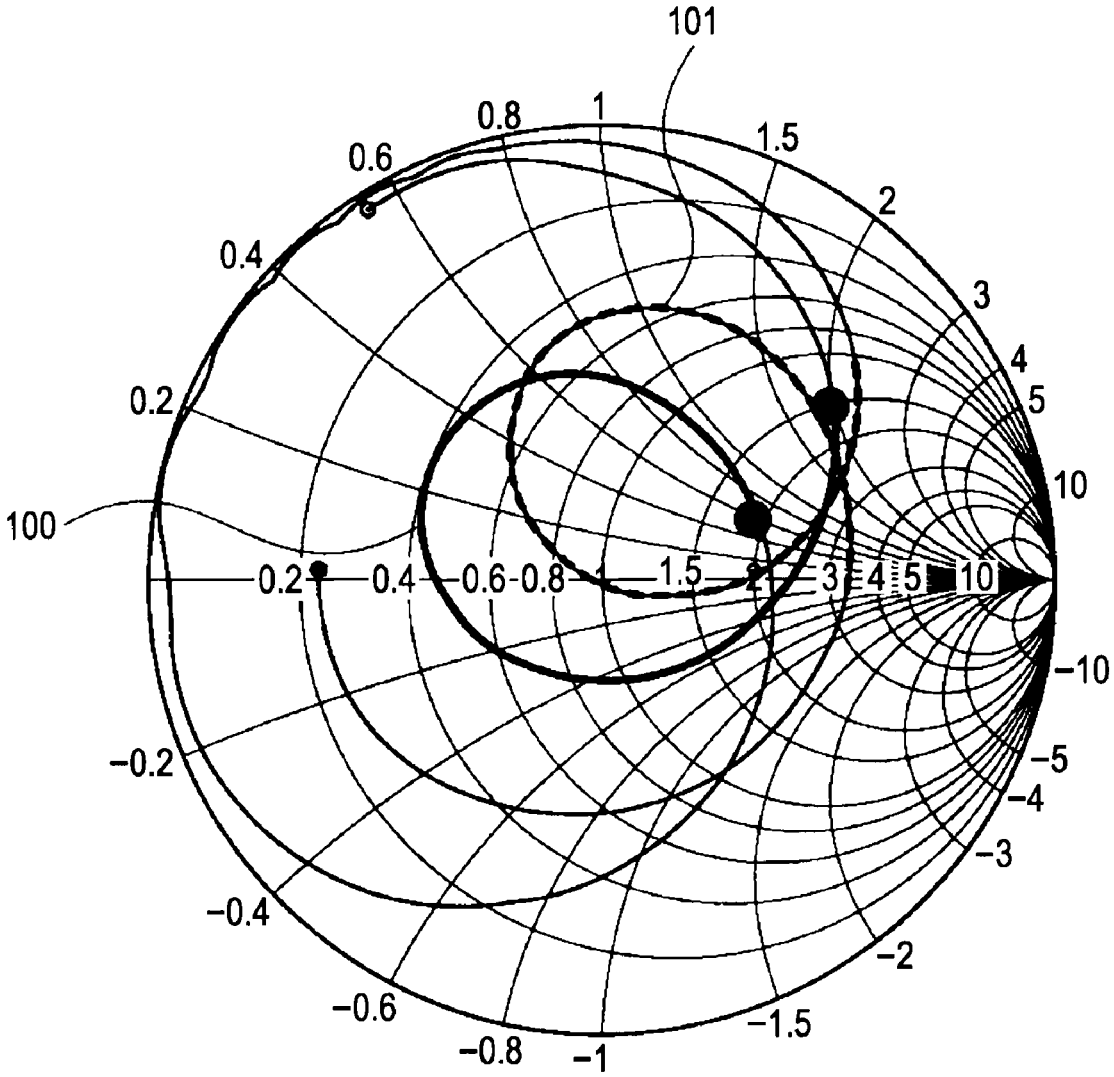
FIG. 5 is the impedance characteristics of the antenna device component according to the first embodiment.
Figure 6:
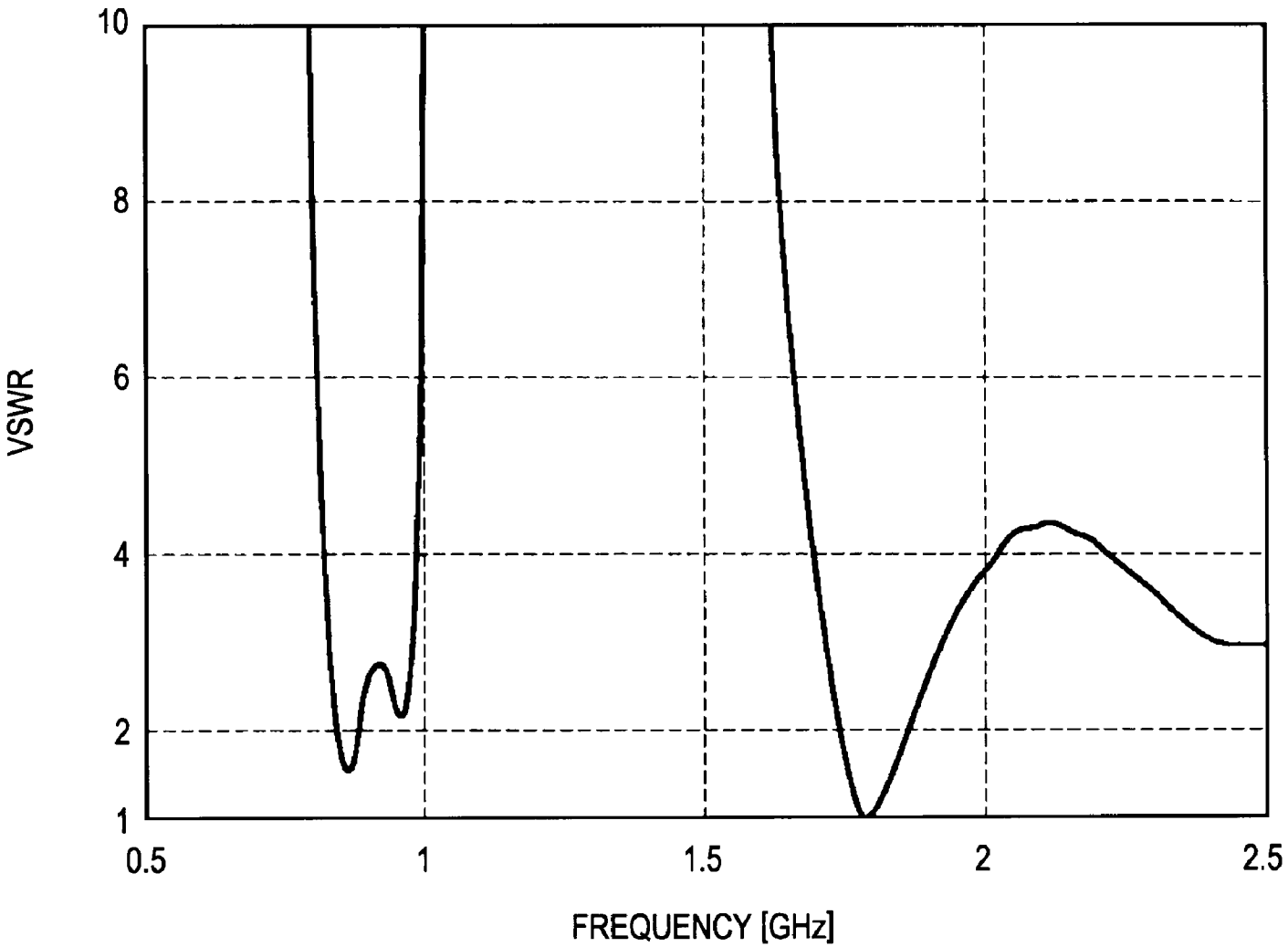
FIG. 6 is the antenna characteristics of the antenna device component according to the first embodiment.

Next, the frequency characteristics of the antenna device component 1 in this example are examined. Specifically, the impedance characteristics of the antenna device component 1 when the antenna element 2 side is considered with respect to the feeding point 3 and the antenna characteristics corresponding to the impedance characteristics are examined. The results are shown in FIG. 5 and FIG. 6. FIG. 5 is a Smith chart that shows the locus of the impedance of the antenna device component 1 when the antenna element 2 side is considered with respect to the feeding point 3. In addition, the antenna characteristics of FIG. 6 show a variation in reflection amount at the feeding point 3 of the antenna device component 1, and the abscissa axis represents a frequency, and the ordinate axis represents a voltage standing wave ratio (VSWR). Note that as the reflection at the feeding point 3 decreases (matching is favorable), the VSWR decreases.

As is apparent from FIG. 5, in the antenna device component 1 of this example, the locus 100 (wide solid line in FIG. 5) of the low-frequency band impedance is present around the center (50 ohms) of the Smith chart as is substantially similar to the locus 101. Note that the frequency range indicated by wide solid line portion in FIG. 5 is a frequency range of 824 MHz to 960 MHz desired for handling both 850 MHz band and 900 MHz band in the GSM. In addition, as is apparent from FIG. 6, the VSWR is about 2.5 to 3.5 in a low-frequency band (824 MHz to 960 MHz), so it appears that the VSWR is sufficiently improved.

From these results, in the antenna device component 1 of this example, it appears that by providing the first bandwidth adjustment circuit 4 and the second bandwidth adjustment circuit 5 shown in FIG. 4, sufficient matching may be obtained in a desired low-frequency band. In addition, the antenna element 2 used in the antenna device component 1 of this example is able to handle only 850 MHz band resonance mode in a low frequency band as described above. Thus, from the results of FIG. 6, in the antenna device component 1 of this example, it appears that by providing the first bandwidth adjustment circuit 4 and the second bandwidth adjustment circuit 5, a low-frequency band is widened toward a high-frequency side.

In addition, as is apparent from FIG. 5, in the antenna device component 1 of this example, the locus 101 (wide broken line in FIG. 5) of the impedance in a high-frequency band is present around the center (50 ohms) of the Smith chart. Note that the frequency range indicated by wide broken line portion in FIG. 5 is a frequency range of 1.71 GHz to 2.17 GHz desired for handling 1800 MHz band and 1900 MHz band in the GSM and 2 GHz band in the UMTS. In addition, as is apparent from FIG. 6, it appears that the VSWR is sufficiently improved in a high-frequency band (1.71 GHz to 2.17 GHz). From these results, in the antenna device component 1 of this example, it appears that favorable matching is also obtained in a high-frequency band.

As described above, in the antenna device component 1 of the present embodiment, the bandwidth of a low-frequency band may be widened to a desired width, and it is possible to handle a plurality of resonance modes (850 MHz band and 900 MHz band) not only in a high-frequency band but also in a low-frequency band.

Comparative Example

Here, in order to further clear the operations and advantages of the first bandwidth adjustment circuit 4 and second bandwidth adjustment circuit 5 in the specific example of the antenna device component 1 of the present embodiment shown in FIG. 4, the frequency characteristics (FIG. 5 and FIG. 6) of the antenna device component 1 of the specific example are compared with the frequency characteristics of the antenna device component having no first and second bandwidth adjustment circuits. That is, the frequency characteristics of the antenna device component 1 of the specific example are compared with the frequency characteristics of the antenna device component 81 (hereinafter, also referred to as antenna device component 81 of the comparative example) shown in FIG. 35. The antenna device component 81 of the comparative example has a similar configuration to the antenna device component 1 of the specific example except that no first and second bandwidth adjustment circuits are provided.

Figure 7:
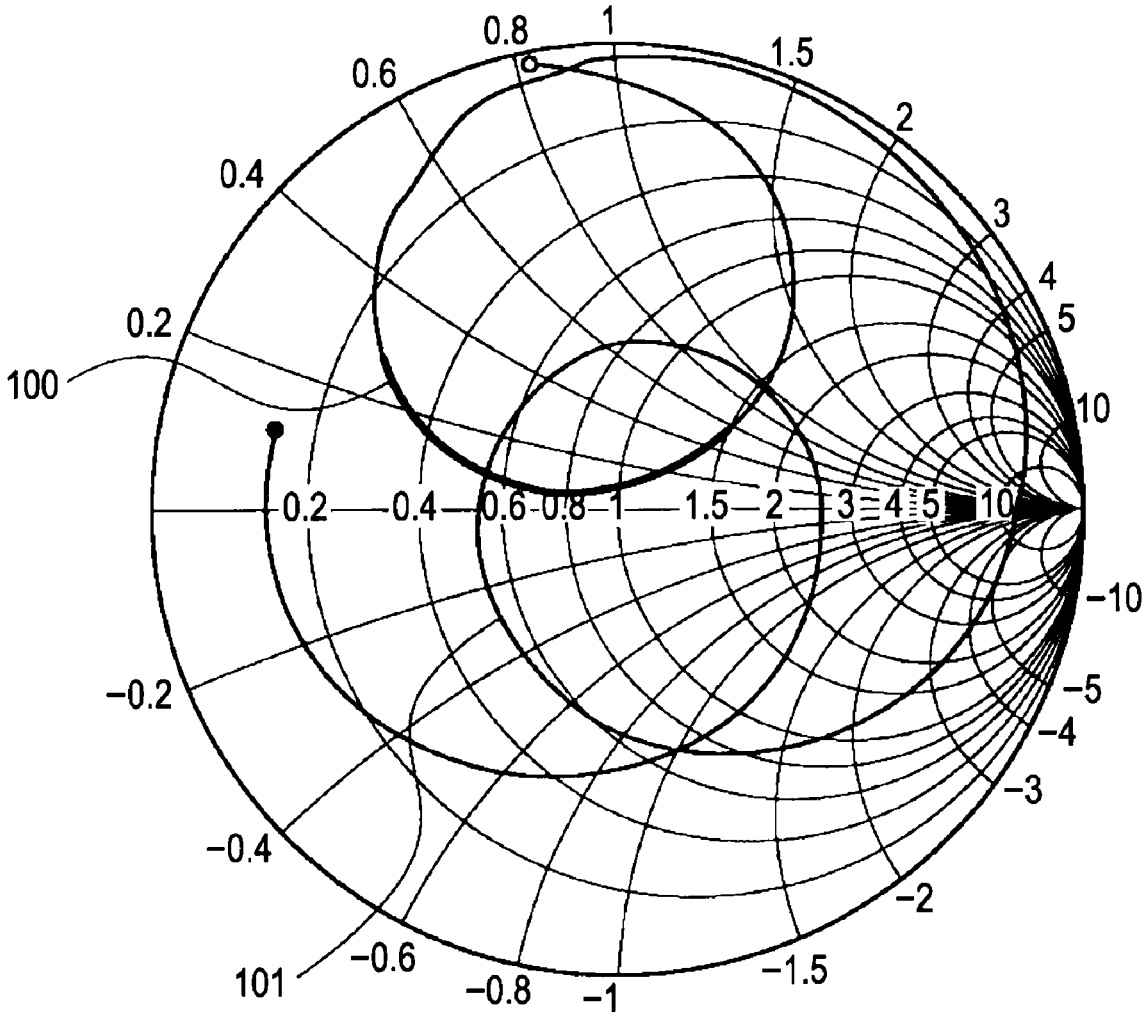
FIG. 7 is the impedance characteristics of an antenna device component according to a comparative example.
Figure 8:
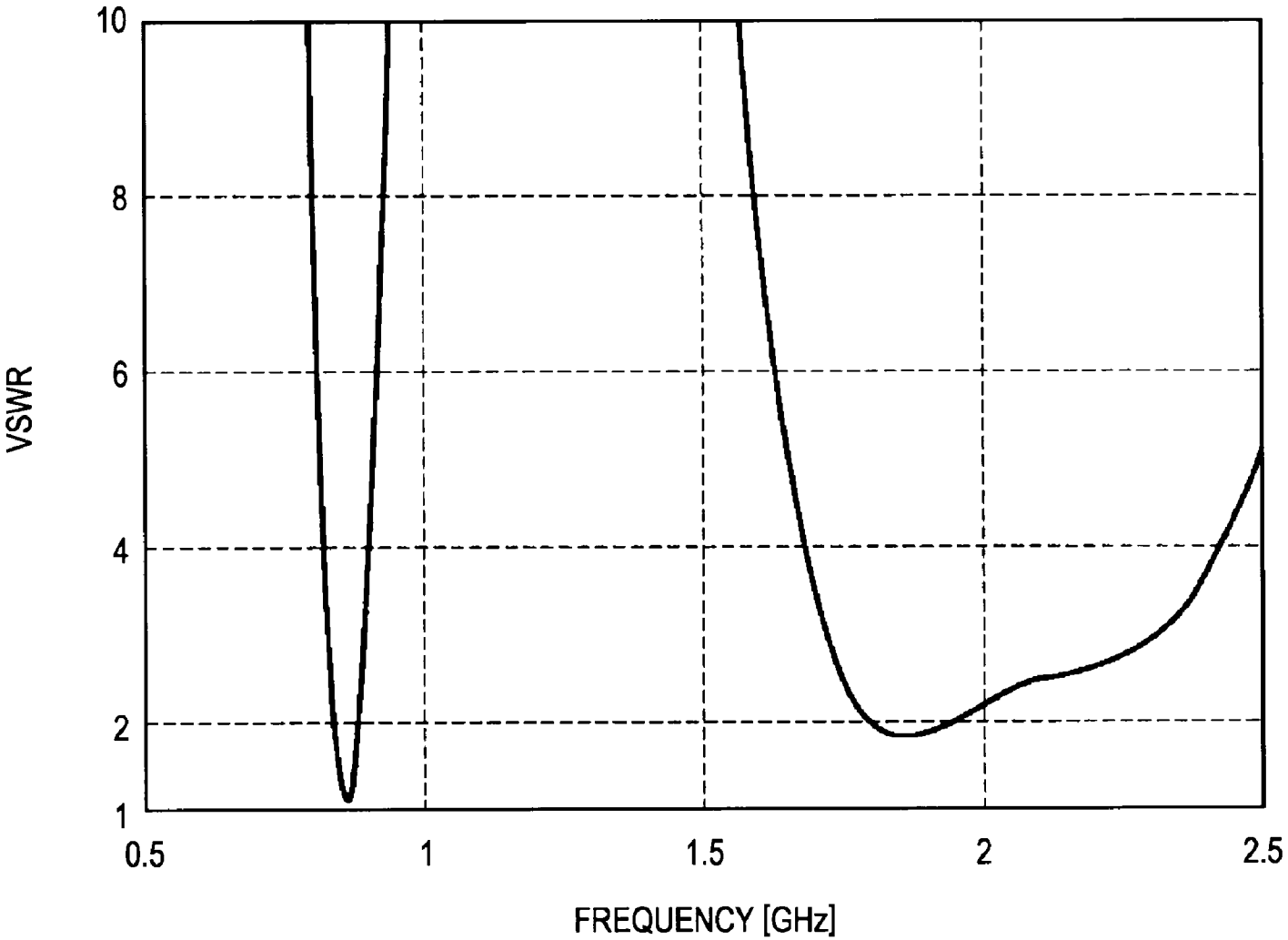
FIG. 8 is the impedance characteristics of the antenna device component according to the comparative example.

The frequency characteristics of the antenna device component 81 of the comparative example are shown in FIG. 7 and FIG. 8. FIG. 7 is a Smith chart that shows the locus of the impedance for frequencies in the antenna device component 81. In addition, FIG. 8 is the antenna characteristics of the antenna device component 81, and the abscissa axis represents a frequency, and the ordinate axis represents a voltage standing wave ratio (VSWR).

In the impedance characteristics (FIG. 5 and FIG. 7) of the specific example and comparative example, when the locus 100 of the impedance in a low-frequency band is compared, it appears that both the impedance characteristics vary around the center (50 ohm) of the Smith chart and, therefore, sufficient matching is obtained in both the impedance characteristics. In addition, in the antenna characteristics (FIG. 6 and FIG. 8) of the specific example and comparative example, when both the characteristics in a low-frequency band are compared, it appears that the bandwidth of the low-frequency band of the specific example is wider toward a high-frequency side than that of the comparative example. From these, it appears that by providing the first and second bandwidth adjustment circuits 4 and 5 as in the case of the specific example, the bandwidth may be widened toward a high-frequency side while obtaining sufficient matching in a low-frequency band.

In addition, when the locus 101 of the impedance in a high-frequency band is compared between the impedance characteristics (FIG. 5 and FIG. 7) of the specific example and comparative example, both the impedance characteristics vary around the center (50 ohms) of the Smith chart and, therefore, it appears that sufficient matching is obtained in both the impedance characteristics. In addition, when the characteristics of the high-frequency band (1.71 GHz to 2.17 GHz) are compared between the antenna characteristics (FIG. 6 and FIG. 8) of the specific example and comparative example, the VSWR is sufficiently reduced in a high-frequency band in both the characteristics. From these, it appears that the antenna device component 1 of the specific example and the antenna device component 81 of the comparative example have substantially similar configurations for signals in a high-frequency band. That is, the first capacitor 4 (first bandwidth adjustment circuit) and the second capacitor 6 of the second bandwidth adjustment circuit 5 in the antenna device component 1 of the specific example are substantially short-circuited for signals in a high-frequency band, and, therefore, it appears that the series resonant circuit 9 of the second bandwidth adjustment circuit 5 is substantially open for signals in a high-frequency band.

Design Principles

Next, the design principles of the antenna device component 1 of the above specific example will be described with reference to FIG. 5 to FIG. 25. Specifically, the design procedure starting from the configuration of the antenna device component 81 of the above described comparative example to the configuration of the antenna device component 1 of the specific example will be described.

Note that the impedance characteristics (Smith chart) of the antenna device component in the following description is a Smith chart that shows the locus of the impedance for frequencies in the antenna device component when the antenna element 2 side is considered with respect to the feeding point 3. In addition, the antenna characteristics in the following description are also the characteristics that show a variation in reflection amount (VSWR) at the feeding point of the antenna device component.

Figure 9:
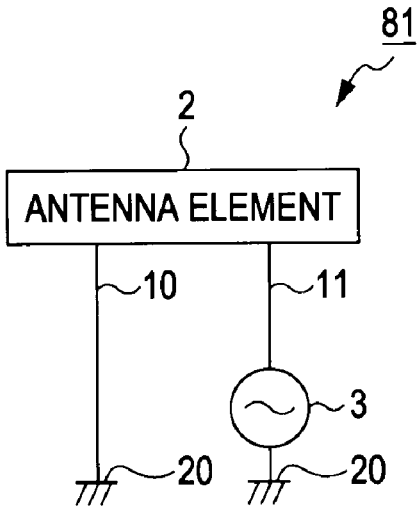
FIG. 9 is a view for illustrating the design principles of the antenna device component according to the first embodiment.

First, the existing antenna device component (antenna device component 81 of the comparative example) having neither the first bandwidth adjustment circuit 4 nor the second bandwidth adjustment circuit 5 is considered. The schematic configuration of the antenna device component 81 is shown in FIG. 9. In the antenna device component 81 shown in FIG. 9, the antenna element 2 is directly grounded by the short-circuit line 10 and is directly connected to the feeding point 3 by the feed line 11.

Note that the antenna element 2 of the antenna device component 81 shown in FIG. 9 is designed to be able to handle 850 MHz band in the GSM in a low-frequency band. This is because in the antenna device component according to the embodiment of the invention, the bandwidth of the low-frequency band is widened toward a high-frequency side, as described above. In addition, the antenna element 2 of the antenna device component 81 shown in FIG. 9 is designed to be able to handle 1800 MHz band and 1900 MHz band in the GSM and 2 GHz band in the UMTS in a high-frequency band.

The impedance characteristics and antenna characteristics of the antenna device component 81 shown in FIG. 9 are respectively shown in FIG. 7 and FIG. 8 described in the comparative example. As is apparent from the antenna characteristics of FIG. 8, in the antenna device component 81, the low-frequency band has single-mode (850 MHz band) narrow band characteristics. On the other hand, the high-frequency band overlappingly includes modes of 1800 MHz band and 1900 MHz band in the GSM and 2 GHz band in the UMTS, so the high-frequency band has wide band characteristics.

Next, in the configuration of the antenna device component 81 shown in FIG. 9, the antenna device component in which the first capacitor 4 having a capacitance of C1 is provided in midway of the short-circuit line 10 that connects the antenna element 2 to the ground point 20 will be considered. The schematic configuration of the antenna device component is shown in FIG. 10.

Figure 10:
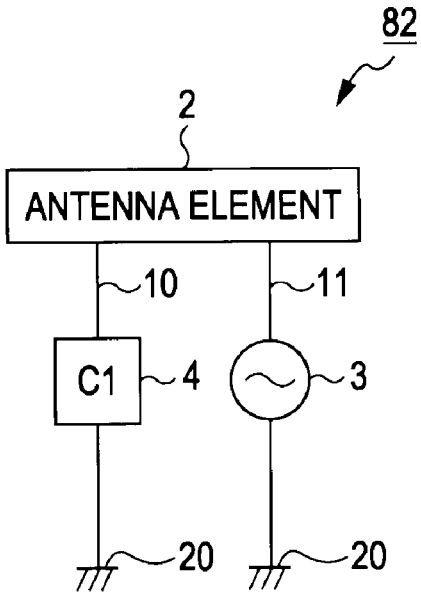
FIG. 10 is a view for illustrating the design principles of the antenna device component according to the first embodiment.

The antenna device component 82 shown in FIG. 10 has such a configuration that the first capacitor 4 is connected in series with the short-circuit line 10. However, the capacitance C1 of the first capacitor 4 is set so that the first capacitor 4 is placed in a substantially short-circuit for signals in a high-frequency band. That is, for signals in a high-frequency band, the capacitance C1 of the first capacitor 4 is set so that the configuration of the antenna device component 82 is substantially the same as the configuration having no first capacitor 4 (configuration of the antenna device component 81 shown in FIG. 9).

Figure 11:
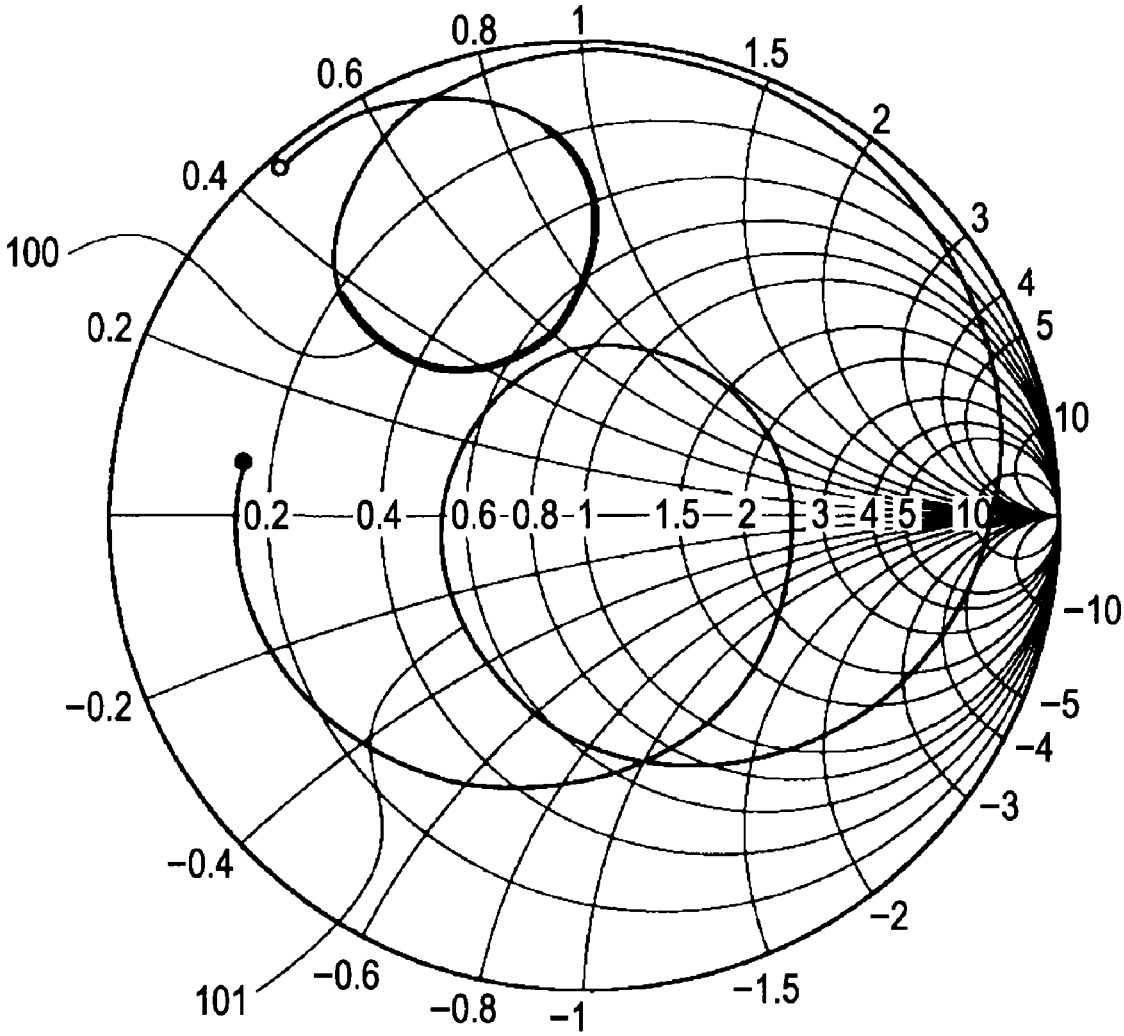
FIG. 11 is a view for illustrating the design principles of the antenna device component according to the first embodiment.
Figure 12:
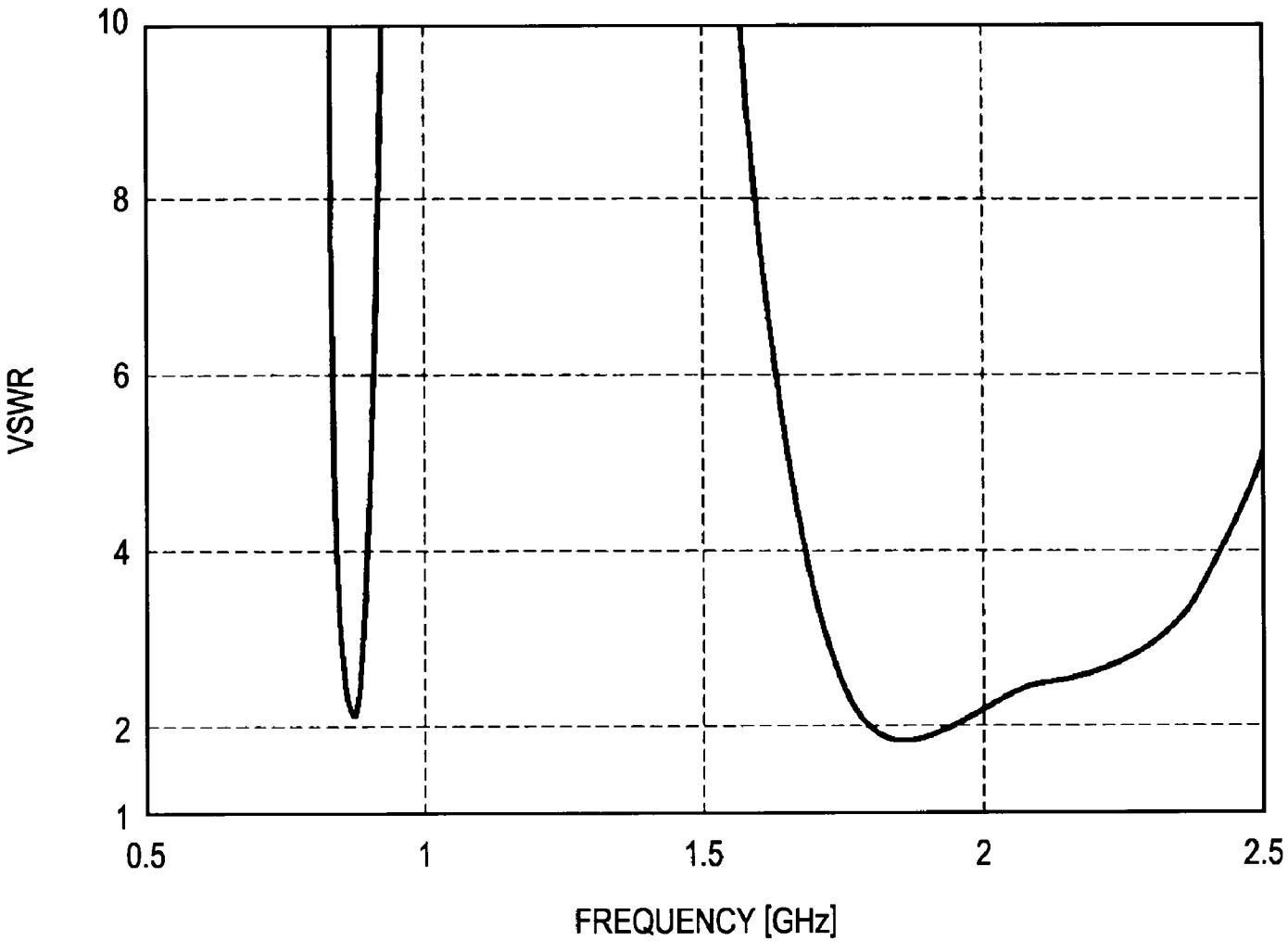
FIG. 12 is a view for illustrating the design principles of the antenna device component according to the first embodiment.

The impedance characteristics and antenna characteristics of the thus configured antenna device component 82 are respectively shown in FIG. 11 and FIG. 12. Note that FIG. 11 and FIG. 12 show the characteristics when the capacitance C1 of the first capacitor 4 is set at 20 pF, and the locus 100 indicated by wide solid line in FIG. 11 is the locus of the impedance in a low-frequency band (824 MHz to 960 MHz).

When the Smith charts of FIG. 11 and FIG. 7 are compared, it appears that the respective loci 101 of the impedance in a high-frequency band (1.71 GHz to 2.17 GHz) in FIG. 11 and FIG. 7 are substantially the same. In addition, when the antenna characteristics of FIG. 12 and FIG. 8 are compared, it appears that the characteristics in a high-frequency band in FIG. 12 and FIG. 8 are substantially the same. From these, it appears that, for signals in a high-frequency band, the configuration of the antenna device component 82 has a substantially similar configuration to that of the antenna device component 81 shown in FIG. 9, and the first capacitor 4 of the antenna device component 82 is placed in a substantially short-circuit state for signals in a high-frequency band.

On the other hand, when the respective loci 100 of the impedance in a low-frequency band in FIG. 11 and FIG. 7 are compared, the locus 100 of the impedance in a low-frequency band in FIG. 7 is located near the center of the Smith chart, and in FIG. 11, the locus 100 is located at the upper left in the Smith chart. In addition, when the antenna characteristics of FIG. 12 and FIG. 8 are compared, it appears that the VSWR of the low-frequency band in FIG. 12 is larger than that of the characteristics of FIG. 8. From these results, it appears that in the antenna device component 82 shown in FIG. 10, matching in a low-frequency band is degraded as compared with the antenna device component 81 shown in FIG. 9. That is, in the antenna device component 82 having the configuration shown in FIG. 10, the frequency characteristics in a high-frequency band may be maintained favorably, but the favorable characteristics may not be obtained in a low-frequency band.

Figure 14:
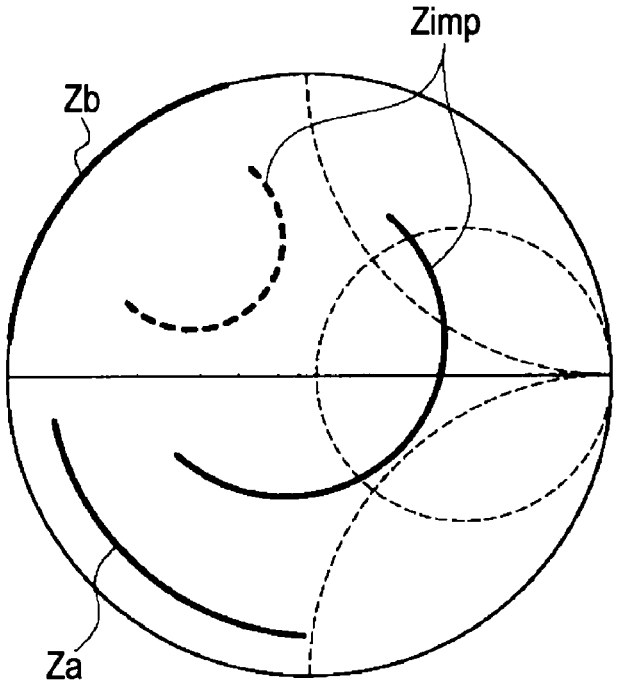
FIG. 14 is a view for illustrating the design principles of the antenna device component according to the first embodiment.
Figure 15:
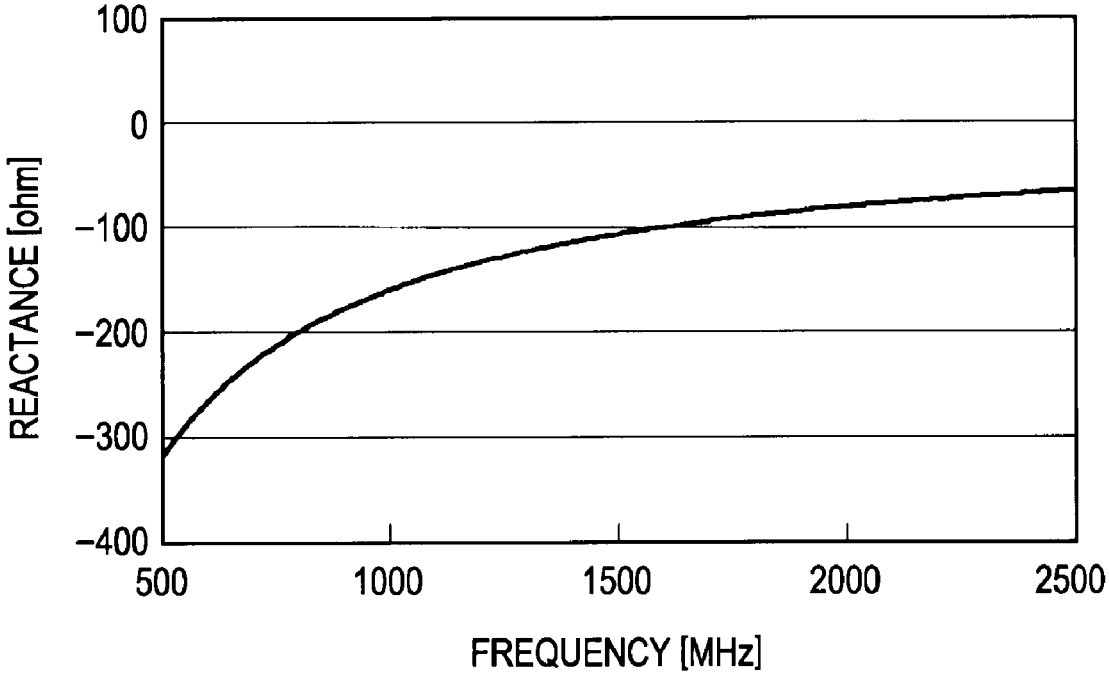
FIG. 15 is a view for illustrating the design principles of the antenna device component according to the first embodiment.

Here, the reason why the frequency characteristics shown in FIG. 11 and FIG. 12 are obtained in the antenna device component 82 shown in FIG. 10 will be described in detail with reference to FIG. 13 to FIG. 15.

Figure 13:
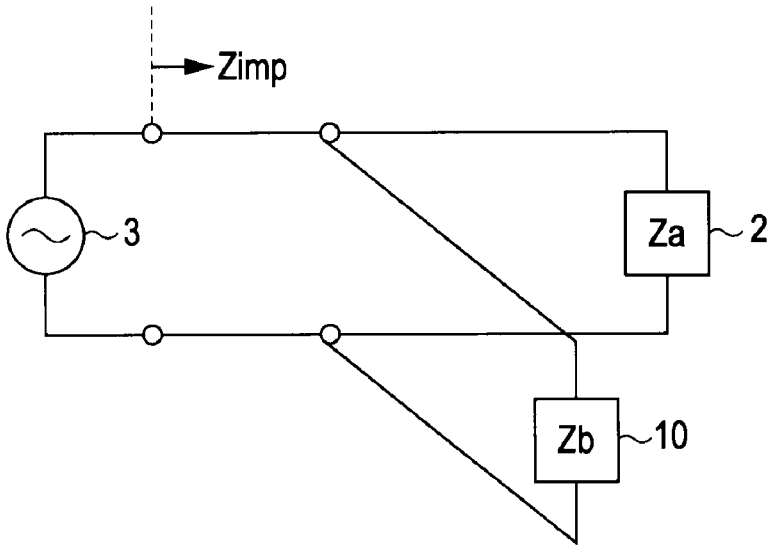
FIG. 13 is a view for illustrating the design principles of the antenna device component according to the first embodiment.

FIG. 13 is an equivalent circuit diagram of the antenna device component 81 (antenna device component of the comparative example) shown in FIG. 9. In the equivalent circuit of the antenna device component 81 shown in FIG. 9, the short-circuit line 10 is represented by an inductor Zb, and the inductor Zb is a circuit that is connected to an equivalent circuit Za (series resonant circuit) of the antenna element 2 in parallel.

The inductance of the short-circuit line 10 varies with the length of the short-circuit line 10. Thus, when the length of the short-circuit line 10 is varied, the impedance Zimp when the antenna element 2 side is considered with respect to the feeding point 3 also varies. Thus, the locus of Zimp in the Smith chart also varies. FIG. 14 shows that state. When the length of the short-circuit line 10 is reduced, as shown in FIG. 14, the locus of the impedance Zimp moves from the center (wide solid line) to the upper left (broken line) in the Smith chart as the diameter of the circular arc locus is reduced.

In consideration of the above described relationship between the length of the short-circuit line 10 and the impedance characteristics, the operation of the first capacitor 4 added to the antenna device component 82 shown in FIG. 10 is considered. The frequency characteristics of the reactance ($1/\omega C$) of the capacitor are the characteristics shown in FIG. 15. In FIG. 15, the abscissa axis represents a frequency, and the ordinate axis represents a reactance. As shown in FIG. 15, the reactance of the capacitor decreases for high-frequency signals. Here, because the first capacitor 4 is placed in a substantially short-circuit for signals in a high-frequency band, the reactance of the first capacitor 4 is extremely small in a high-frequency band. In contrast, signals in a low-frequency band receive the influence of the reactance of the first capacitor 4.

That is, because the first capacitor 4 of the antenna device component 82 shown in FIG. 10 is placed in a substantially short-circuit state against signals in a high-frequency band, the length of the short-circuit line 10 is substantially unchanged. Thus, in the antenna device component 82 shown in FIG. 10, the locus 101 of the impedance in a high-frequency band almost does not move as shown in FIG. 11.

On the other hand, because the first capacitor 4 of the antenna device component 82 shown in FIG. 10 functions as a capacitor for signals in a low-frequency band, the length of the short-circuit line 10 is substantially reduced. Thus, in the antenna device component 82, as shown in FIG. 11, the locus 100 of the impedance in a low-frequency band moves to the upper left (matching degrades).

Figure 16:
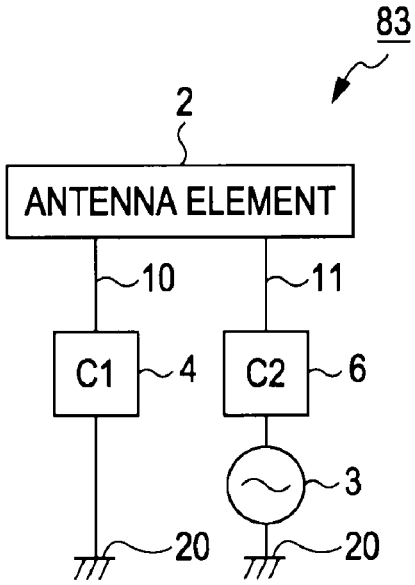
FIG. 16 is a view for illustrating the design principles of the antenna device component according to the first embodiment.

Next, an antenna device component in which the second capacitor 6 having a capacitance of C2 is additionally inserted in series between the antenna element 2 and the feeding point 3 in the configuration of the antenna device component 82 shown in FIG. 10 is considered. The schematic configuration of the antenna device component is shown in FIG. 16. The second capacitor 6 is provided in order to minutely adjust the impedance characteristics in a low-frequency band. Specifically, the second capacitor 6 adjusts the center position of the locus (circular arc locus) of the impedance in a low-frequency band in the Smith chart. However, the capacitance C2 of the second capacitor 6 is set so that the second capacitor 6, as well as the first capacitor 4, is placed in a substantially short-circuit state for signals in a high-frequency band.

Figure 17:
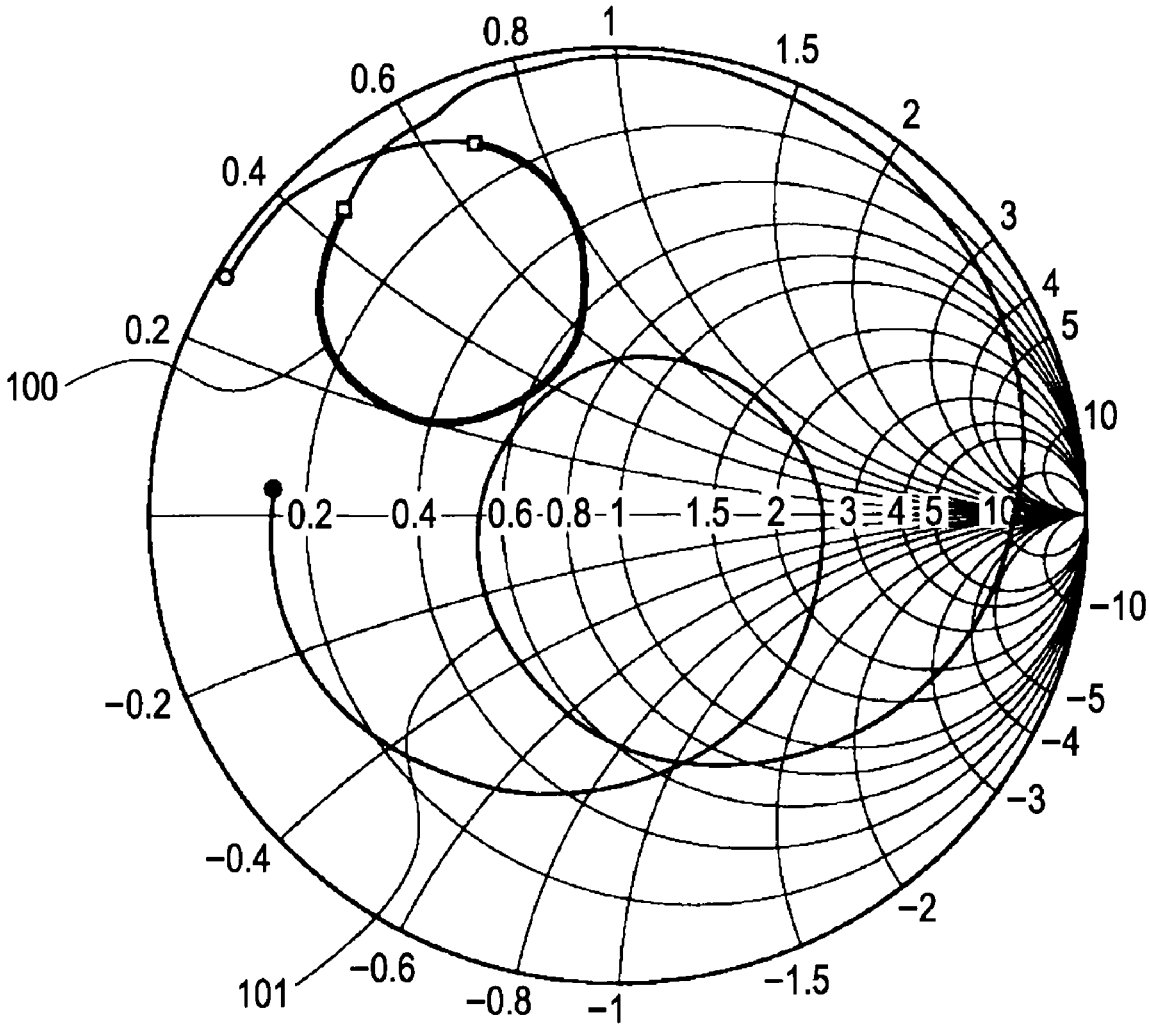
FIG. 17 is a view for illustrating the design principles of the antenna device component according to the first embodiment.
Figure 18:
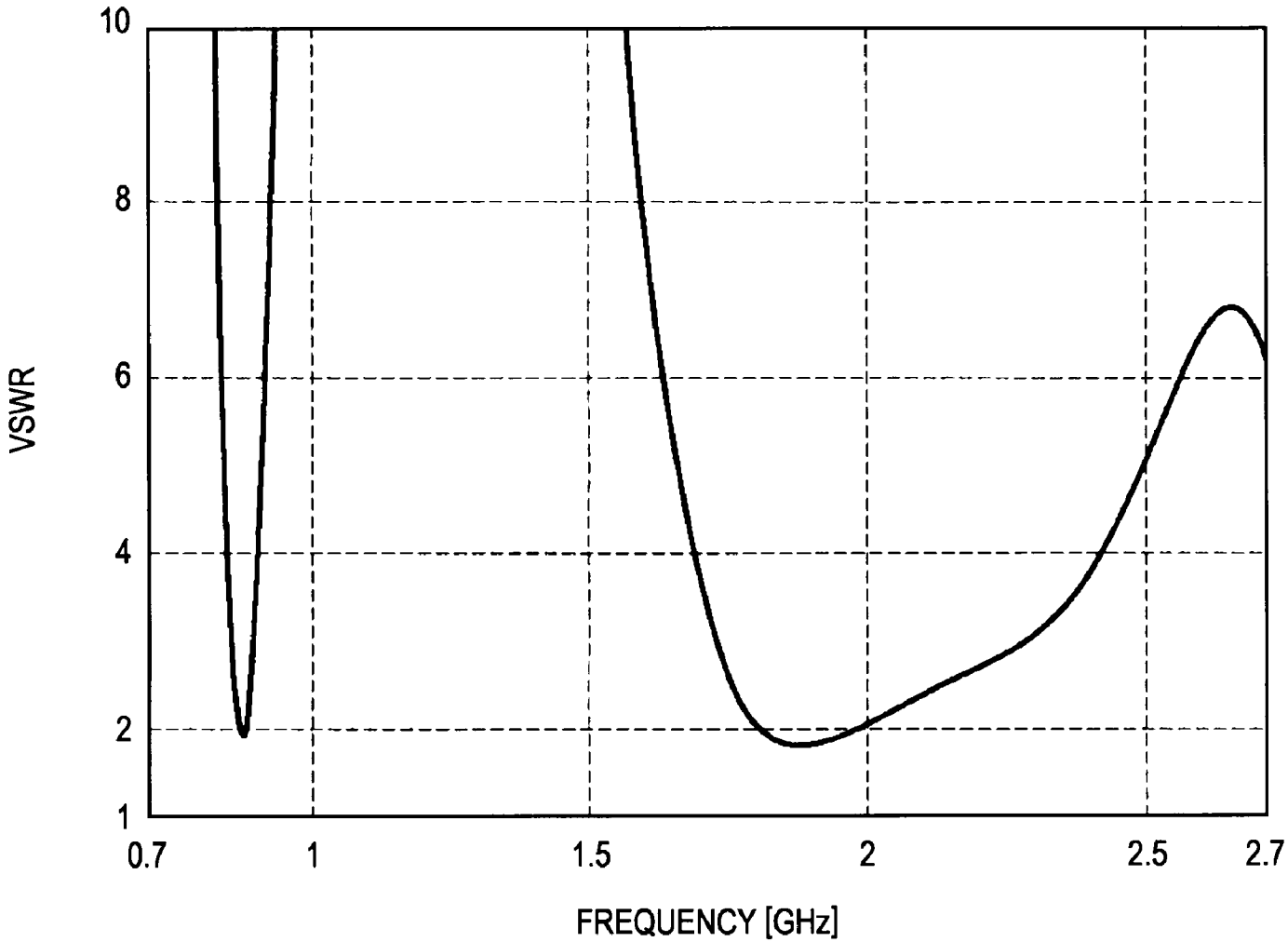
FIG. 18 is a view for illustrating the design principles of the antenna device component according to the first embodiment.

The impedance characteristics and antenna characteristics of the antenna device component 83 shown in FIG. 16 are respectively shown in FIG. 17 and FIG. 18. Note that the characteristics shown in FIG. 17 and FIG. 18 are characteristics when the capacitance C1 of the first capacitor 4 is set at 20 pF, and the capacitance C2 of the second capacitor 6 is set at 27 pF.

When the impedance characteristics shown in FIG. 17 and FIG. 11 are compared, it appears that, by providing the second capacitor 6, the center position of the circular arc locus 100 of the impedance in a low-frequency band slightly changes, and the diameter of the locus 100 also slightly increases. On the other hand, the loci 101 of the impedance in a high-frequency band are substantially the same between FIG. 17 and FIG. 11.

In addition, when the antenna characteristics shown in FIG. 18 and FIG. 12 are compared, the characteristics shown in FIG. 18 in a low-frequency band has a VSWR that is slightly smaller than the characteristics shown in FIG. 12 in a low-frequency band, whereas substantially the same characteristics are obtained in a high-frequency band. From the results shown in FIG. 18 and FIG. 12, it appears that, for signals in a high-frequency band, the configuration of the antenna device component 83 has a substantially similar configuration to that of the antenna device component 82 shown in FIG. 10, and the second capacitor 6 of the antenna device component 83 is placed in a substantially short-circuit state for signals in a high-frequency band.

As described above, in the antenna device component 83 shown in FIG. 16, it is possible to maintain wide and favorable characteristics in a high-frequency band; however, it has a narrow band in a low-frequency band. Then, next, in the antenna device component 83 shown in FIG. 16, the configuration in which the locus of the impedance in a low-frequency band is moved to the center in the Smith chart to widen the bandwidth will be considered. The configuration of the antenna device component is shown in FIG. 19.

Figure 19:
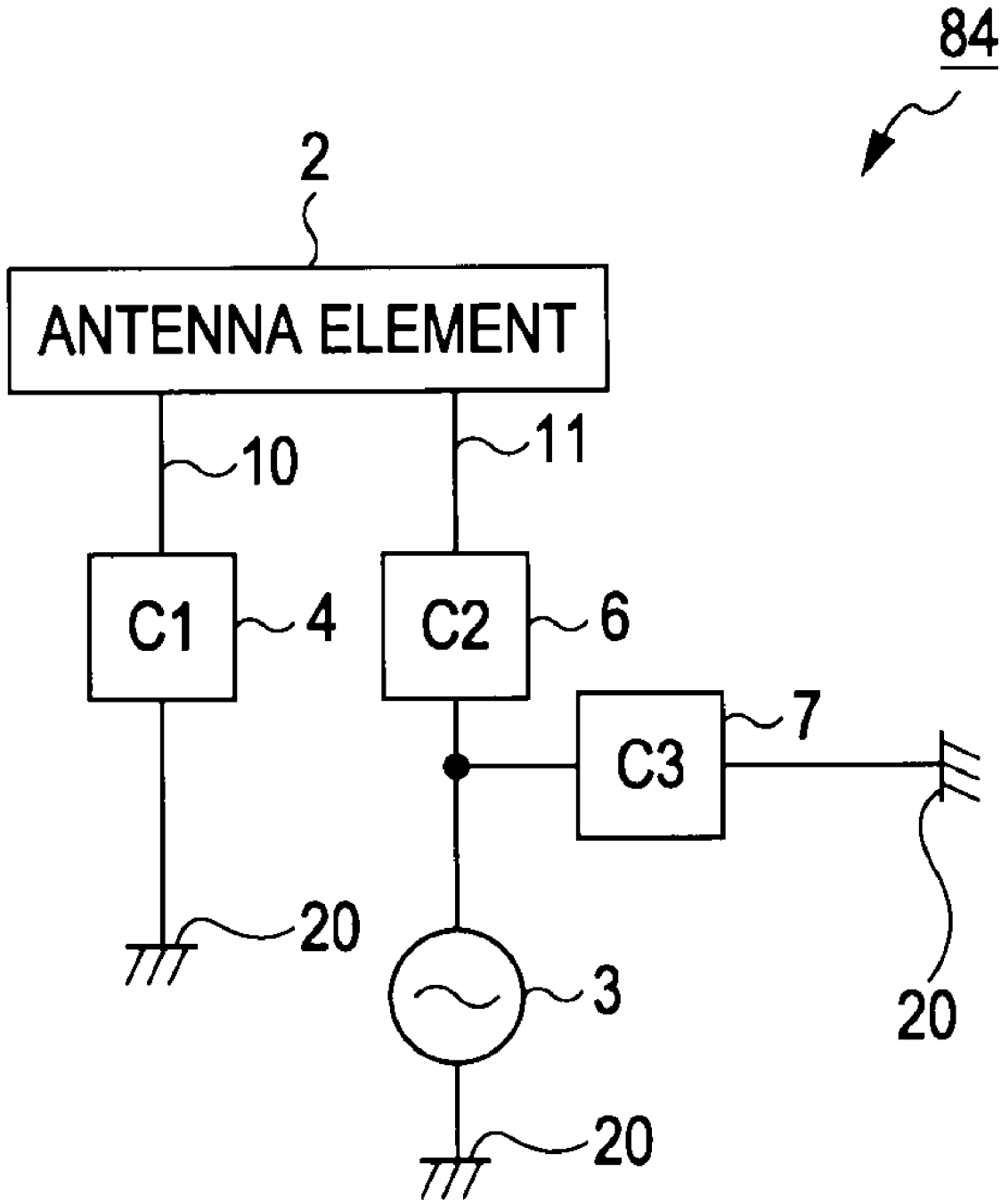
FIG. 19 is a view for illustrating the design principles of the antenna device component according to the first embodiment.

The antenna device component 84 shown in FIG. 19 further includes a third capacitor 7 having a capacitance of C3 in addition to the configuration of the antenna device component 83 shown in FIG. 16. Specifically, as shown in FIG. 19, one of the terminals of the third capacitor 7 is connected to the feed line 11 that connects the second capacitor 6 with the feeding point 3, and the other terminal is grounded.

The capacitance C3 of the third capacitor 7 is appropriately set in accordance with the necessary bandwidth of the low-frequency band. Here, the capacitance C3 of the third capacitor 7 is set at 6 pF so that the VSWR is 2.5 to 3.5 in a low-frequency band of 824 MHz to 960 MHz. Note that the capacitance c1 of the first capacitor 4 is set at 20 pF, and the capacitance C2 of the second capacitor 6 is set at 27 pF. The impedance characteristics and antenna characteristics of the antenna device component 84 in this case are respectively shown in FIG. 20 and FIG. 21.

Figure 20:
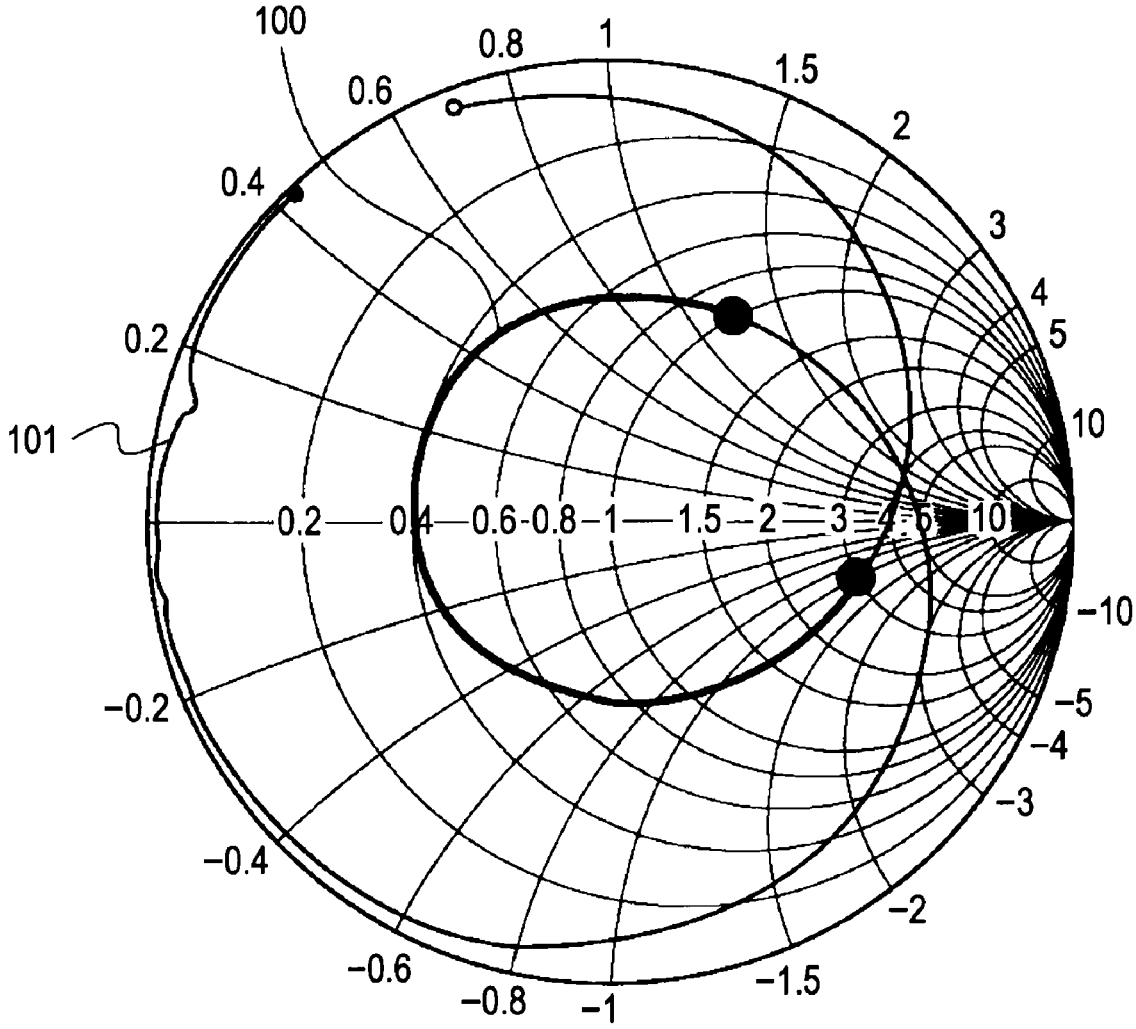
FIG. 20 is a view for illustrating the design principles of the antenna device component according to the first embodiment.

As is apparent from the characteristics shown in FIG. 20, in the antenna device component 84 shown in FIG. 19, it appears that, by providing the third capacitor 7, the locus 100 of the impedance in a low-frequency band moves to the center on the Smith chart. In addition, as is apparent from the characteristics shown in FIG. 21, it appears that the VSWR is 2.5 to 3.5 in a desired low-frequency band (824 MHz to 960 MHz).

Figure 21:
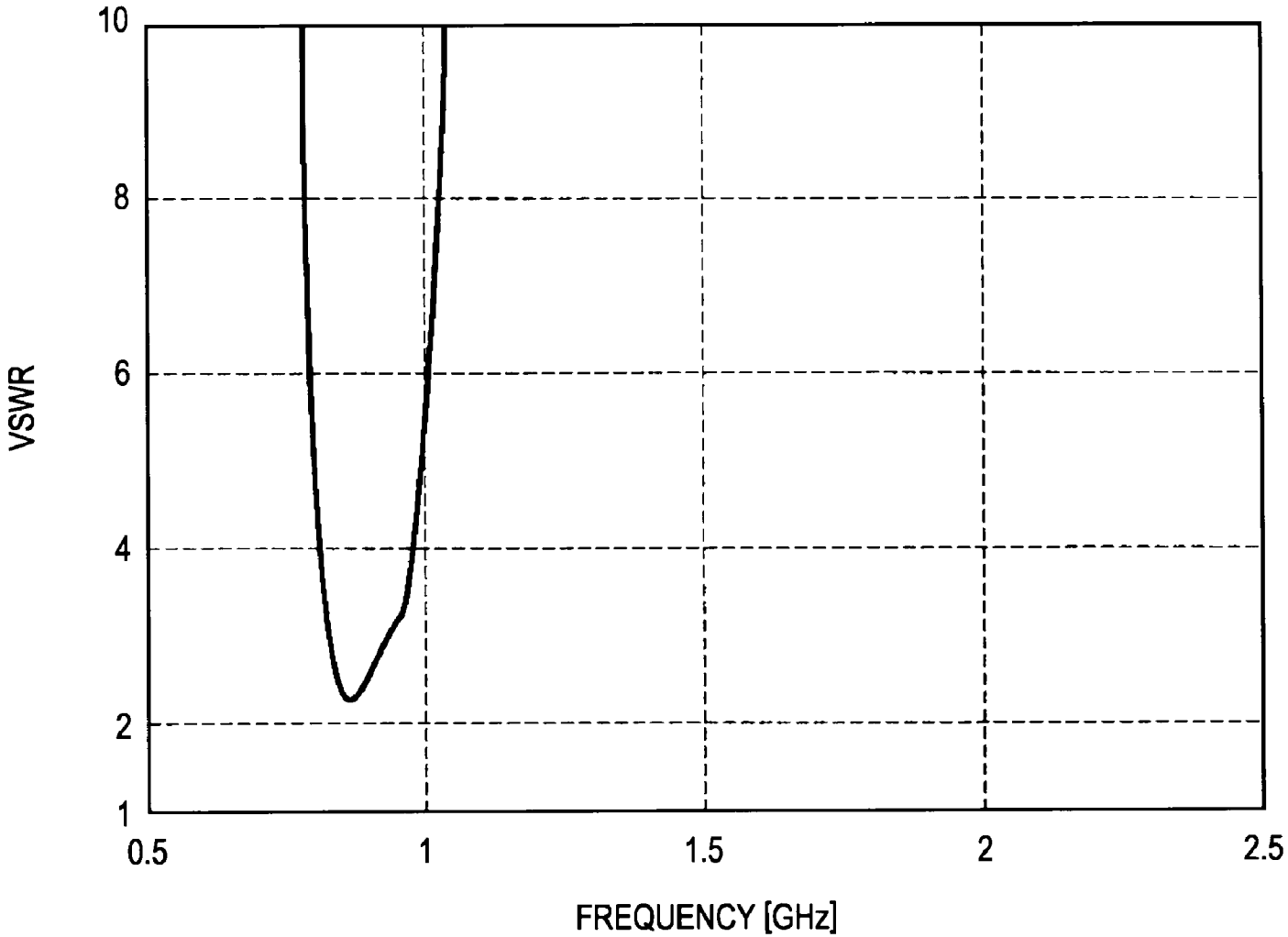
FIG. 21 is a view for illustrating the design principles of the antenna device component according to the first embodiment.

Furthermore, when the antenna characteristics shown in FIG. 21 and FIG. 18 are compared, it appears that the bandwidth of the low-frequency band is widened in the antenna device component 84 shown in FIG. 19. In addition, from the comparison between the characteristics shown in FIG. 21 and FIG. 18, it appears that, with the third capacitor 7, the low-frequency band of the antenna device component 84 shown in FIG. 19 widens toward a high-frequency side.

However, as is apparent from the results shown in FIG. 20 and FIG. 21, in the antenna device component 84 shown in FIG. 19, matching in a high-frequency band degrades. This is because the third capacitor 7 is placed in a substantially short-circuit state for signals in a high-frequency band.

Next, in the antenna device component 84 shown in FIG. 19, a configuration that improves matching in a high-frequency band while maintaining favorable characteristics in a low-frequency band will be considered. The configuration is the antenna device component 1 shown in FIG. 3 and FIG. 4 described in the present embodiment. That is, in the antenna device component 84 shown in FIG. 19, in order to improve matching in a high-frequency band, the first inductor 8 having an inductance of L1 is connected in series with the third capacitor 7.

However, the reactance characteristics for signals in a low-frequency band differ between the series resonant circuit 9, formed of the third capacitor 7 and first inductor 8 of the antenna device component 1 shown in FIG. 3, and the third capacitor 7 of the antenna device component 84 shown in FIG. 19. Therefore, in the antenna device component 1 shown in FIG. 3, the capacitance C3 of the third capacitor 7 and the inductance L1 of the first inductor 8 are adjusted again so that the VSWR is 2.5 to 3.5 with a desired bandwidth (824 MHz to 960 MHz) of the low-frequency band.

Figure 22:
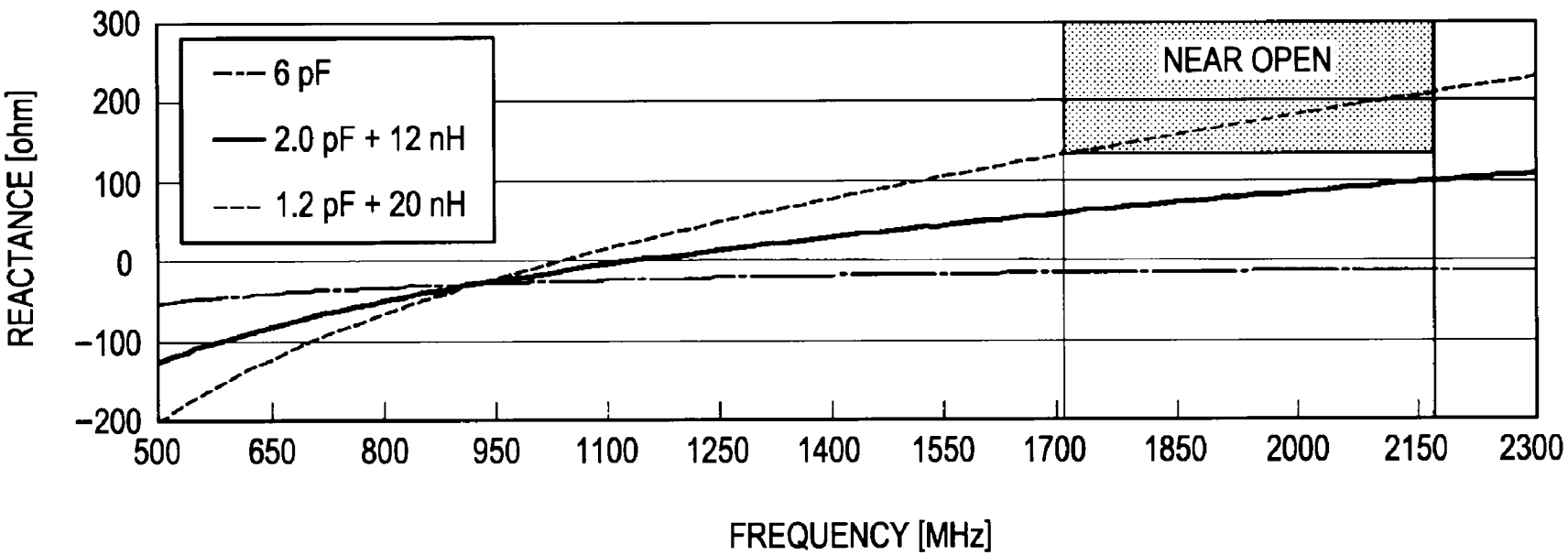
FIG. 22 is a view for illustrating the design principles of the antenna device component according to the first embodiment.

The reactance characteristics of the series resonant circuit 9 formed of the third capacitor 7 and the first inductor 8 in the antenna device component 1 of FIG. 3 are shown in FIG. 22. FIG. 22 shows the reactance characteristics of the series resonant circuit 9 when a combination of the capacitance C3 of the third capacitor 7 and the inductance L1 of the first inductor 8 is changed. Specifically, FIG. 22 shows the characteristics when C3=1.2 pF and L1=20 nH (characteristics indicated by broken line in FIG. 22) and when C3=2 pF and L1=12 nH (characteristics indicated by solid line in FIG. 22). In addition, for comparison, FIG. 22 also shows the characteristics (characteristics indicated by alternate long and short dashed line in FIG. 22) when C3=6 pF, L1=0 nH, and only with the third capacitor (the antenna device component shown in FIG. 19).

When no first inductor 8 is provided (with only the third capacitor), as shown by the characteristics indicated by alternate long and short dashed line in FIG. 22, the reactance is extremely small and is placed in a substantially short-circuit state in a high-frequency band (1.71 to 2.17 GHz).

However, when the first inductor 8 having a predetermined inductance is connected in series with the third capacitor 7, as shown by the solid line and broken line characteristics in FIG. 22, the reactance in a high-frequency band increases and is not placed in a short-circuit state. Particularly, when the capacitance C3 of the third capacitor 7 is set at 1.2 pF, the inductance L1 of the first inductor 8 is set at 20 nH (broken line characteristics in FIG. 22), the reactance of the series resonant circuit 9 is higher than or equal to about 140 ohms in a high-frequency band and, therefore, the series resonant circuit 9 is placed in a substantially open state.

However, even when the series resonant circuit 9 is placed in a substantially open state in a high-frequency band, the rate of change in reactance (slope of the reactance characteristics) increases depending on a combination of the capacitance C3 of the third capacitor 7 and the inductance L1 of the first inductor 8. In this case, because a difference in reactance between frequencies at both ends of the low-frequency band and the high-frequency band increases, there is a possibility that desired characteristics may not be obtained over the entire range of the low-frequency band and high-frequency band. An example of this case is shown in FIG. 23 and FIG. 24.

Figure 23:
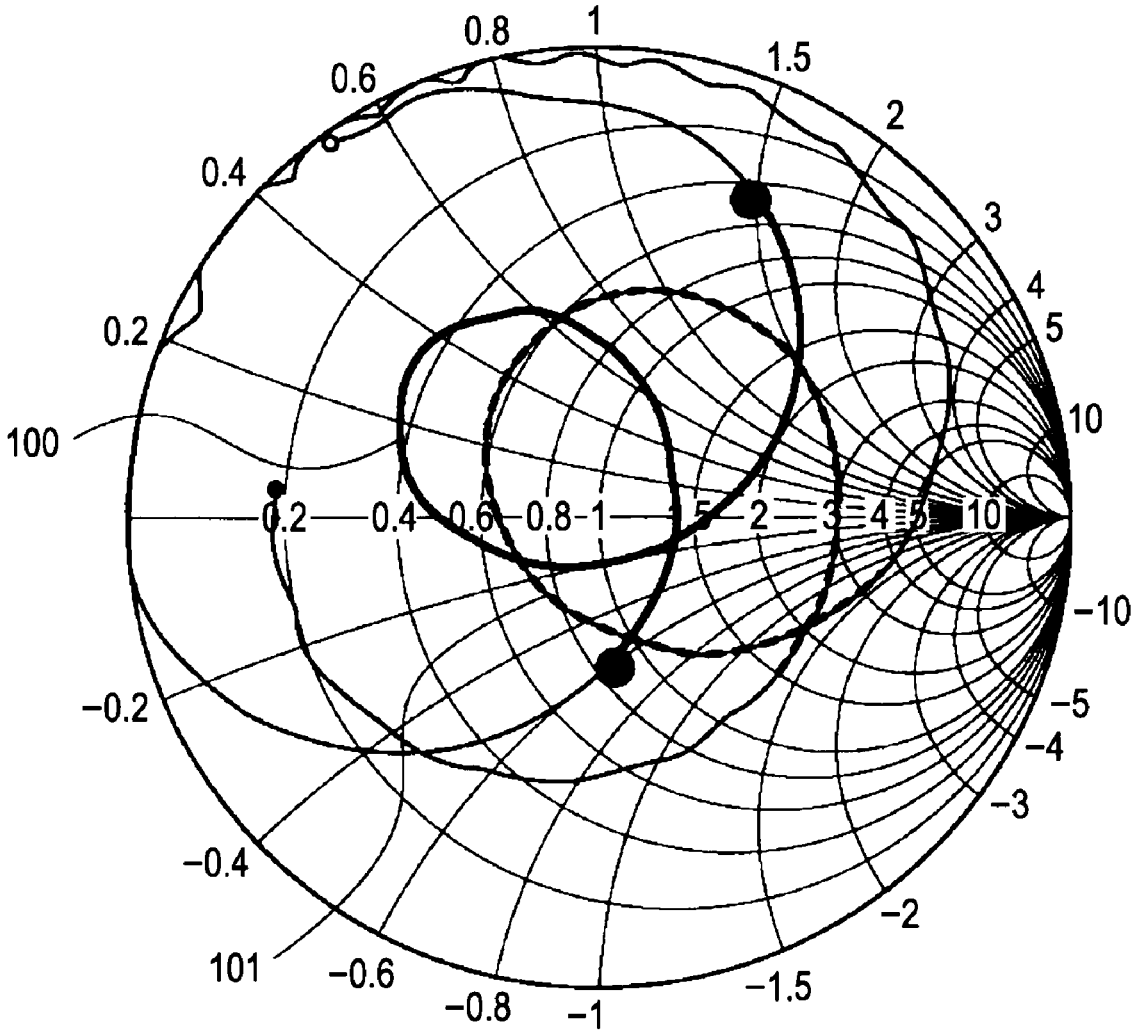
FIG. 23 is a view for illustrating the design principles of the antenna device component according to the first embodiment.
Figure 24:
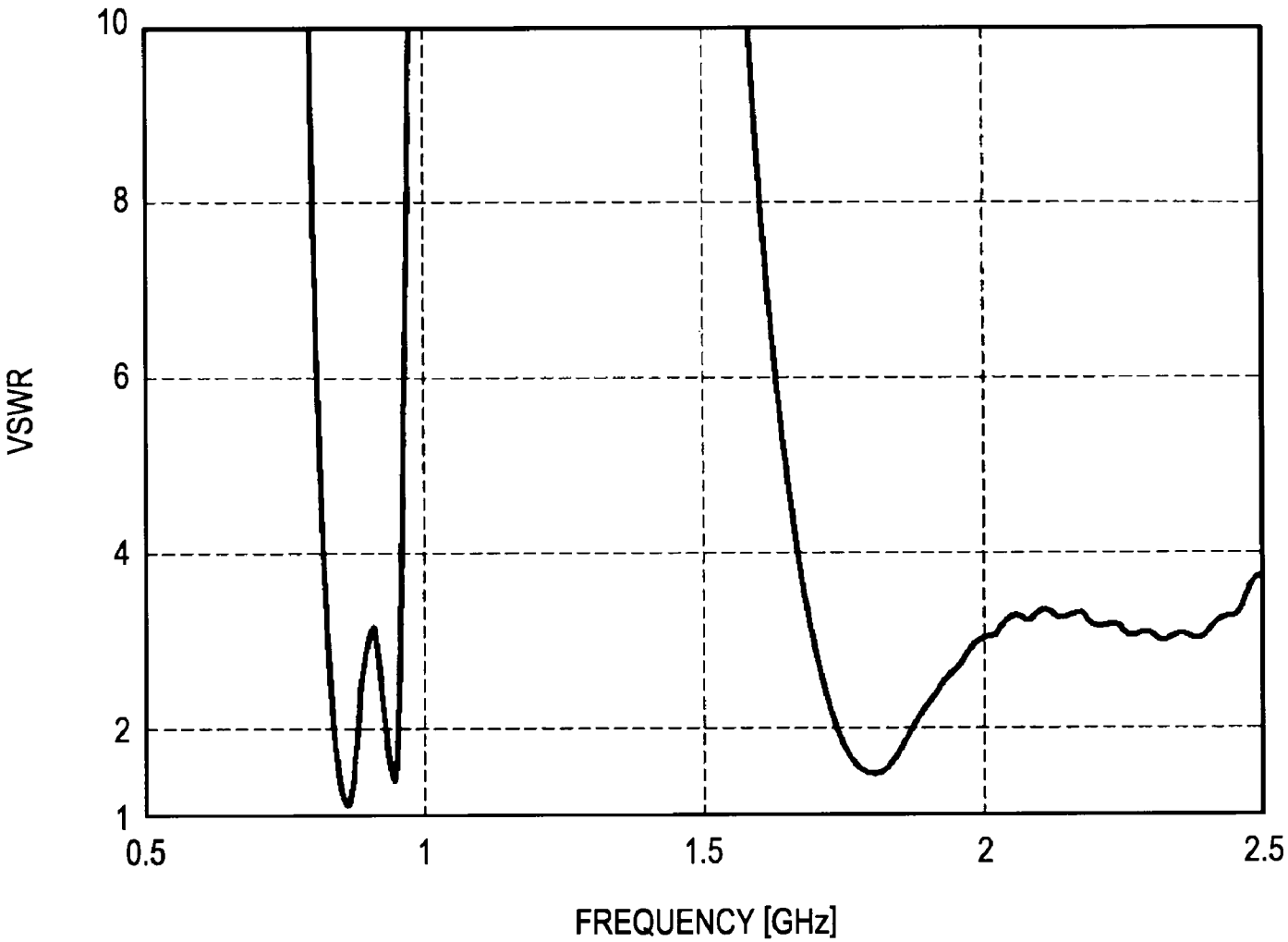
FIG. 24 is a view for illustrating the design principles of the antenna device component according to the first embodiment.

FIG. 23 and FIG. 24 respectively show the impedance characteristics and the antenna characteristics when the capacitance C3 of the third capacitor 7 is 1.2 pF and the inductance L1 of the first inductor 8 is 20 nH in the configuration of the antenna device component 1 shown in FIG. 3.

When the impedance characteristics shown in FIG. 23 and FIG. 5 are compared, it appears that both ends (solid circle points) of the locus 100 of the impedance in a low-frequency band in FIG. 23 are distanced from the center of the Smith chart as compared with the locus of FIG. 5. In addition, when the antenna characteristics shown in FIG. 24 and FIG. 6 are compared, it appears that both characteristics in a high-frequency band are favorable but, in a low-frequency band, the bandwidth is slightly narrower in the characteristics shown in FIG. 24 than that shown in FIG. 6.

From the results shown in FIG. 23 and FIG. 24, when the capacitance C3 of the third capacitor 7 is 1.2 pF and the inductance L1 of the first inductor 8 is 20 nH in the configuration of the antenna device component 1 shown in FIG. 3, it appears that matching is degraded around both ends of the frequencies in a low-frequency band. This is presumably because variations in the reactance characteristics of the series resonant circuit 9 in a low-frequency band increase and, therefore, a difference in reactance at frequencies of both ends of the low-frequency band is increased.

Thus, when a combination of the capacitance C3 of the third capacitor 7 and the inductance L1 of the first inductor 8 is set in the configuration of the antenna device component 1 shown in FIG. 3, it is desirable to set a combination of the capacitance C3 and the inductance L1 so that a difference in reactance at frequencies of both ends of each of the low-frequency band and the high-frequency band is reduced as much as possible.

That is, it may be necessary to appropriately design the series resonant circuit 9 so that the series resonant circuit 9 is placed in a substantially open in a high-frequency band, and a difference in reactance of the series resonant circuit 9 at frequencies of both ends of each of the low-frequency band and the high-frequency band is reduced as much as possible.

In consideration of the above, in the specific example of the present embodiment, the series resonant circuit 9 is formed of the third capacitor 7, of which the capacitance C3 is set at 2 pF, and the first inductor 8, of which the inductance L1 is set at 10 nH. In this case, as shown in FIG. 5 and FIG. 6, it is possible to improve the characteristics in a high-frequency band while maintaining favorable characteristics in a low-frequency band.

Figure 25A:
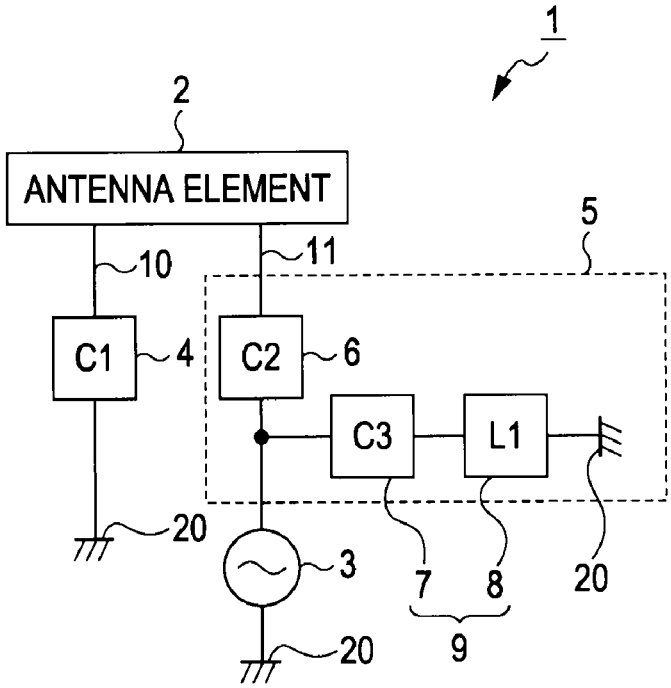
FIG. 25A is an equivalent configuration diagram of the antenna device component in a low-frequency band according to the first embodiment.
Figure 25B:
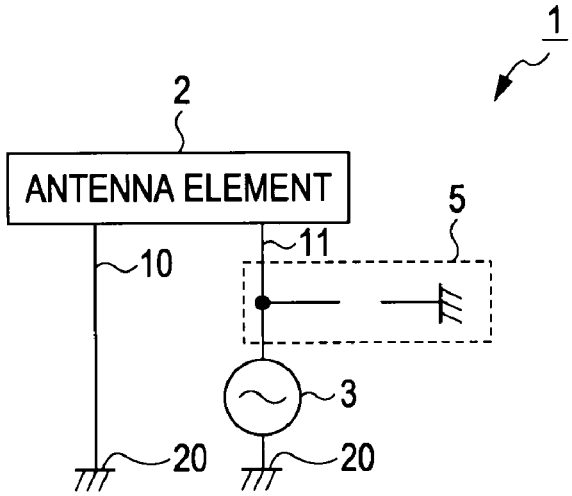
FIG. 25B is an equivalent configuration diagram of the antenna device component in a high-frequency band according to the first embodiment.

As is apparent from the above design principles, the antenna device component 1 of the present embodiment is different between the configuration for signals in a low-frequency band and the configuration for signals in a high-frequency band. FIG. 25A and FIG. 25B show the above different configurations. For signals in a low-frequency band, as shown in FIG. 25A, the antenna device component 1 of the present embodiment includes the first capacitor 4, the second capacitor 6 and the series resonant circuit 9. On the other hand, for signals in a high-frequency band, as shown in FIG. 25B, the antenna device component 1 of the present embodiment is such that the first capacitor 4 and the second capacitor 6 are placed in a substantially short-circuit state, and the series resonant circuit 9 is placed in a substantially open state.

As in the above manner, in the antenna device component of the present embodiment, the first and second bandwidth adjustment circuits formed of the capacitors and the inductor are provided outside the antenna element, and the capacitance of each capacitor and the inductance of the inductor are appropriately set on the basis of the design principles. Thus, it is possible to widen the low-frequency band to a predetermined bandwidth while obtaining the characteristics of the high-frequency band. That is, in the present embodiment, by appropriately setting the capacitance of each capacitor and the inductance of the inductor in the first and second bandwidth adjustment circuits, it is possible to handle a plurality of resonance modes not only in a high-frequency band but also in a low-frequency band.

In addition, as described above, in the present embodiment, the first and second bandwidth adjustment circuits formed of the capacitor and/or the inductor are just provided respectively between the antenna element and the ground point and between the antenna element and the feeding terminal point. Thus, in the present embodiment, it is possible to further simplify the antenna device component and the structure of the mobile communication terminal equipped with the antenna device component.

In addition, in the present embodiment, the bandwidth of the low-frequency band may be widened by providing the first and second bandwidth adjustment circuits outside the antenna element. Thus, it is not necessary to change the design method for the antenna element. In addition, in the present embodiment, as described above, because the design principles of the antenna device component are clear, it is also easy to adjust the frequency characteristics of the antenna device component.

In addition, the capacitors and the inductor used in the first and second bandwidth adjustment circuits are relatively cheap and easy to manufacture. Thus, according to the present embodiment, it is possible to provide an antenna device component that is low-cost with high mass productivity and a mobile communication terminal equipped with the antenna device component.

Furthermore, in the present embodiment, it may be necessary to have a space for mounting the capacitors and the inductor used in the first and second bandwidth adjustment circuits inside the antenna device component. This increases the size of the antenna device component by that space. However, in comparison with the antenna device component that does not employ the configuration of the embodiment of the invention and that, for example, is able to handle a plurality of low-frequency bands by elongating the path of the antenna conductor, it is possible to miniaturize the antenna device component by about 10 to 30%.

Second Embodiment

Figure 27:
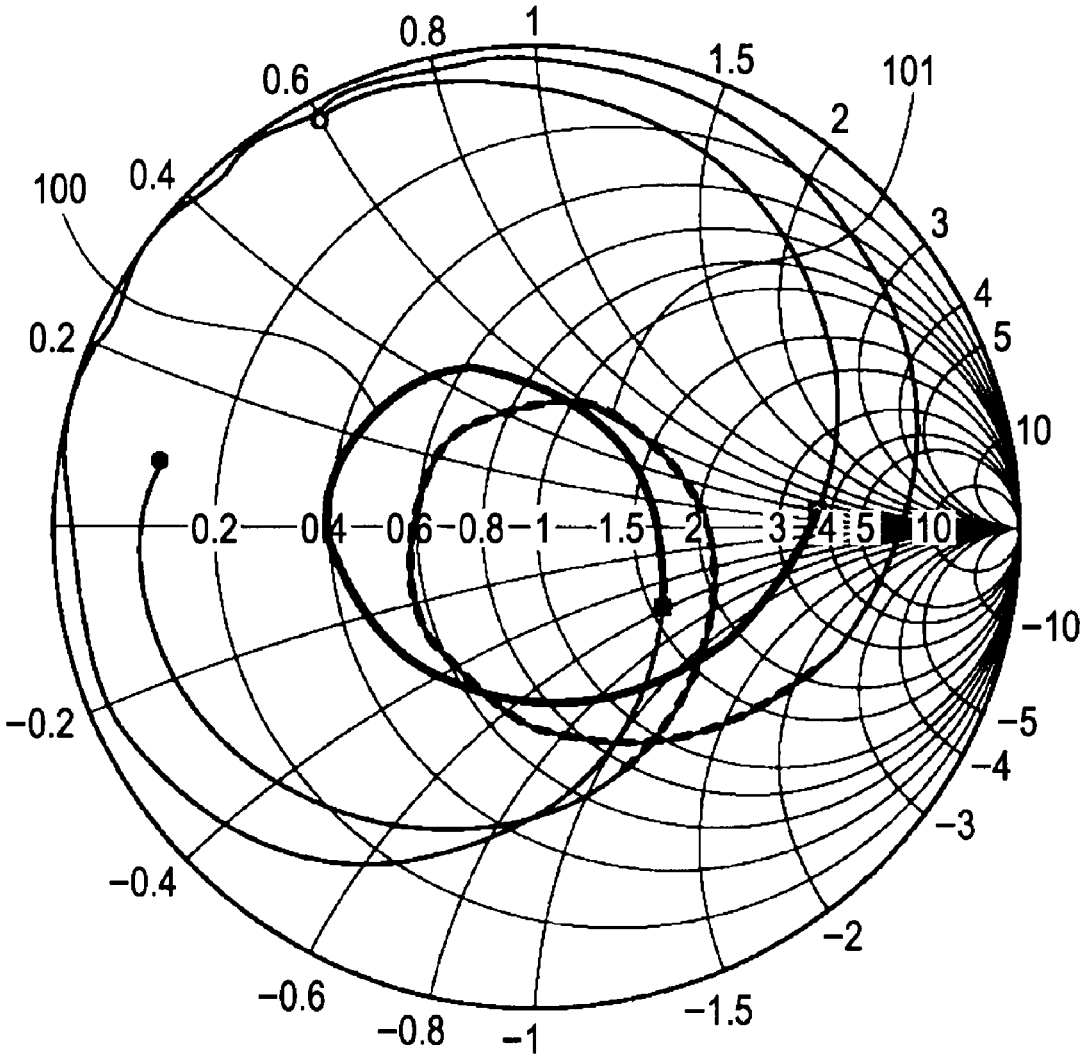
FIG. 27 is the impedance characteristics of the antenna device component according to the second embodiment.
Figure 28:
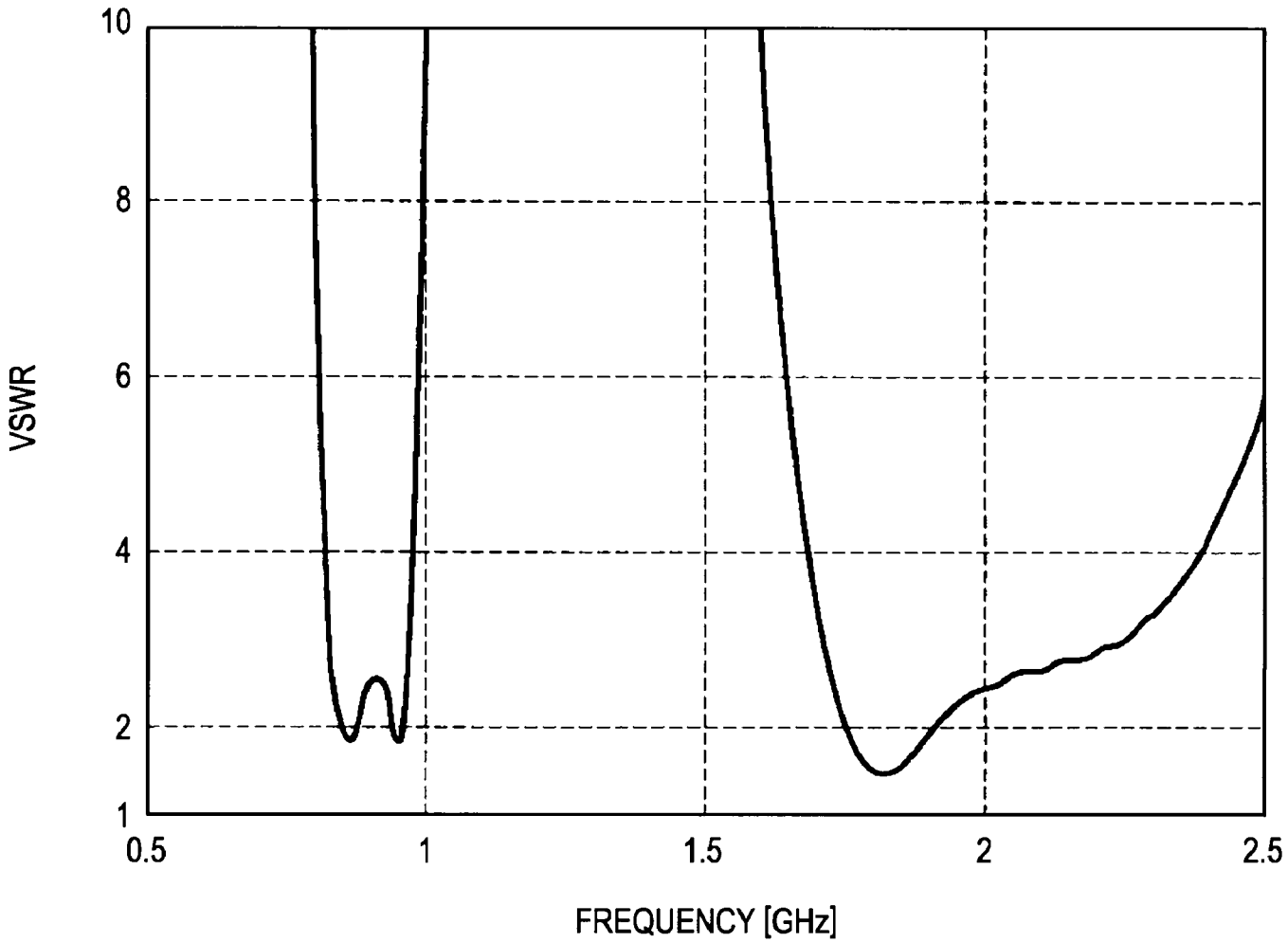
FIG. 28 is the antenna characteristics of the antenna device component according to the second embodiment.

An example of an antenna device component according to a second embodiment of the invention will be described with reference to FIG. 26 to FIG. 28. In the second embodiment, the antenna device component that further improves matching in a high-frequency band as compared with that of the first embodiment will be described.

Configuration of Antenna Device Component

Figure 26:
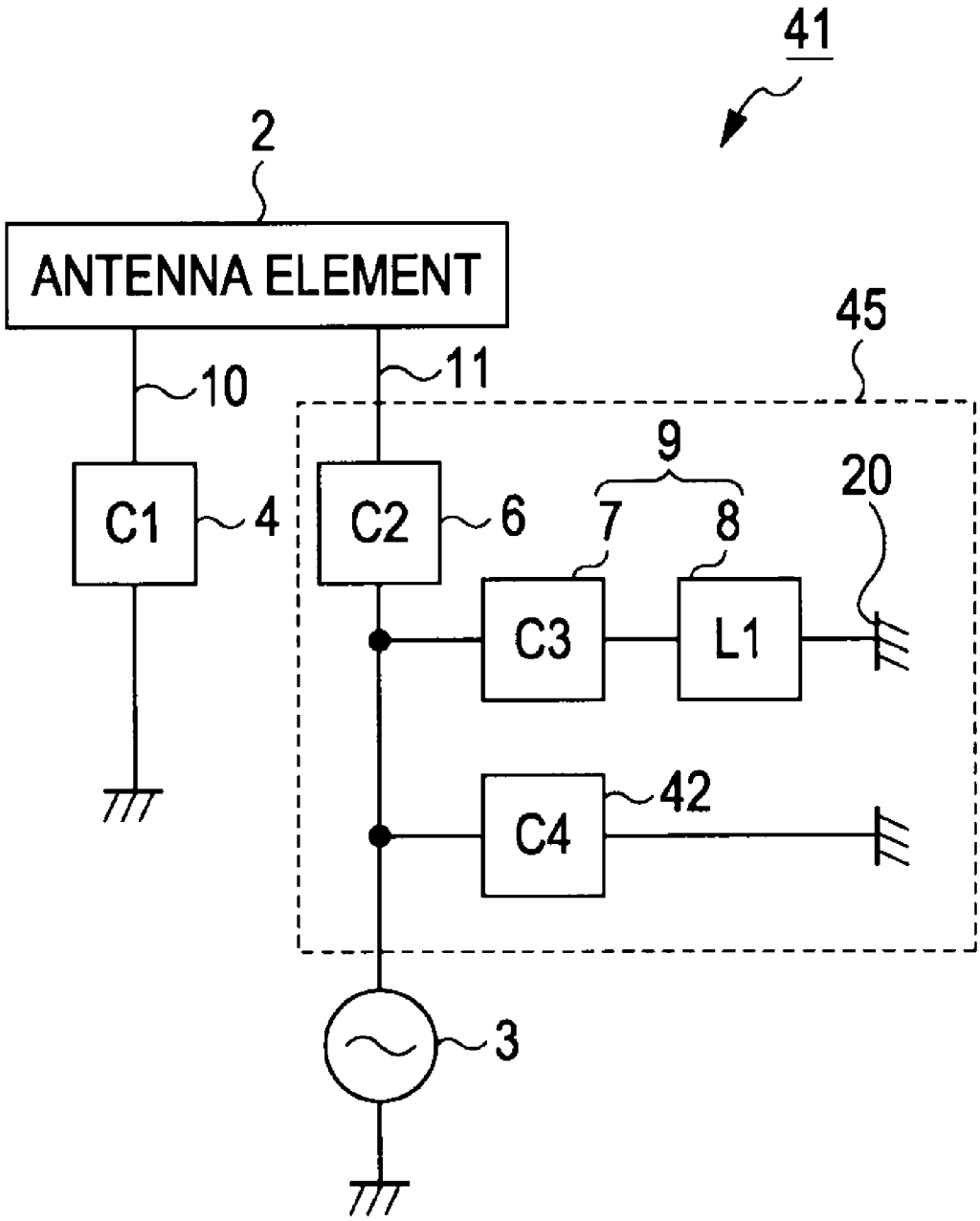
FIG. 26 is a schematic configuration diagram of an antenna device component according to a second embodiment.

The schematic configuration of the antenna device component according to the present embodiment is shown in FIG. 26. Note that the antenna device component of the present embodiment is a single-feeder antenna device component with multiband capability. As shown in FIG. 26, the antenna device component 41 of the present embodiment includes an antenna element 2, a feeding point 3, a first bandwidth adjustment circuit 4 (first capacitor 4) and a second bandwidth adjustment circuit 45.

In the present embodiment, as is apparent from comparison between FIG. 26 and FIG. 3, the configuration of the second bandwidth adjustment circuit of the antenna device component is changed from that of the first embodiment shown in FIG. 3. The other configuration is similar to that of the first embodiment. Thus, here, only the second bandwidth adjustment circuit will be described, and the description of the other components is omitted.

As shown in FIG. 26, the second bandwidth adjustment circuit 45 includes a series resonant circuit 9, formed of a second capacitor 6, a third capacitor 7 and a first inductor 8, and a fourth capacitor 42 having a capacitance of C4, which is connected in parallel with the series resonant circuit 9.

The antenna device component 1 of the first embodiment is configured so that the series resonant circuit 9 is placed in a substantially open state for signals in a high-frequency band. That is, in the second bandwidth adjustment circuit 5, the circuit between the feed line 11 and the ground point 20 is placed in a substantially open state for signals in a high-frequency band. In contrast, in the present embodiment, by connecting the fourth capacitor 26 in parallel with the series resonant circuit 11, in the circuit between the feed line 11 and the ground point 20, the influence of the reactance of the circuit for signals in a high-frequency band slightly appears. That is, in the present embodiment, the circuit between the feed line 11 and the ground point 20 is not completely placed in an open state for signals in a high-frequency band.

The fourth capacitor 42 is provided in order to further improve matching in a high-frequency band. By providing the fourth capacitor 42 as shown in FIG. 26, it is possible to reduce variations in the reactance of the second bandwidth adjustment circuit 45 in a high-frequency band, thus making it possible to further improve matching in a high-frequency band.

Next, a specific example of the antenna device component of the above described second embodiment will be described. Here, the configuration of the antenna device component of the second embodiment is applied to the antenna device component shown in FIG. 35 as an example. Note that in this example, the antenna device component is able to handle 850 MHz band and 900 MHz band in the GSM in a low-frequency band, and is able to handle 1800 MHz band and 1900 MHz band in the GSM and 2 GHz band in the UMTS.

Note that the antenna element 2 of the specific example of the present embodiment, as well as the specific example of the first embodiment, is designed so as to be able to handle 850 MHz band in the GSM in a low-frequency band and 1800 MHz band and 1900 MHz band in the GSM and 2 GHz band in the UMTS in a high-frequency band.

In addition, in this example, in FIG. 26, the capacitance C1 of the first capacitor 4 is set at 20 pF, and the capacitance C2 of the second capacitor 6 is set at 27 pF. In addition, the capacitance C3 of the third capacitor 7 is set at 2 pF, the inductance L1 of the first inductor 8 is set at 10 nH, and then the capacitance C4 of the fourth capacitor 42 is set at 1 pF.

Frequency Characteristics

Next, the frequency characteristics of the antenna device component 41 in this example are examined as well as the specific example of the first embodiment. The results are shown in FIG. 27 and FIG. 28. FIG. 27 is a Smith chart that shows the locus of the impedance of the antenna device component 41 when the antenna element 2 side is considered with respect to the feeding point 3. In addition, FIG. 28 is the antenna characteristics of the antenna device component 41 of this example, the abscissa axis represents a frequency, and the ordinate axis represents a voltage standing wave ratio (VSWR).

First, the impedance characteristics (FIG. 5) of the antenna device component 1 of the specific example of the first embodiment are compared with the impedance characteristics (FIG. 27) of the antenna device component 41 of the specific example of the present embodiment. First, when the loci 100 (wide solid line) of the impedance in a low-frequency band are compared, it appears that both loci are substantially the same. On the other hand, when the loci 101 (wide broken line) of the impedance in a high-frequency band are compared, it appears that the locus 101 of the impedance of the antenna device component 41 of the specific example of the present embodiment is located closer to the center in the Smith chart than that of the first embodiment.

In addition, the antenna characteristics (FIG. 6) of the antenna device component 1 of the first embodiment are compared with the antenna characteristics (FIG. 28) of the antenna device component 41 of the specific example of the present embodiment. When the characteristics in a low-frequency band are compared, it appears that both characteristics have substantially the same characteristics. On the other hand, when the characteristics in a high-frequency band are compared, it appears that variations in VSWR in a high-frequency band of the specific example of the present embodiment are smaller than those of the first embodiment. From these results, it appears that the antenna device component 41 of the specific example of the present embodiment obtains further stable matching over the entire high-frequency band as compared with the antenna device component 1 of the first embodiment.

Third Embodiment

An example of an antenna device component according to a third embodiment of the invention will be specifically described with reference to FIG. 29 and FIG. 30.

In the antenna device component 1 of the first embodiment, the first capacitor 4 (first bandwidth adjustment circuit) and the second capacitor 6 and third capacitor 7 of the second bandwidth adjustment circuit 5 are substantially placed in a short-circuit state for signals in a high-frequency band. That is, the antenna device component 1 is configured so that the reactance of each of the first capacitor 4, the second capacitor 6 and the third capacitor 7 in a high-frequency band is extremely small and may be ignored. However, for example, as shown in FIG. 15, the reactance of the capacitor is not completely equal to 0 in a high-frequency band. Then, the inventors studied the influence of the reactance of the capacitor in a high-frequency band and found the following facts.

When, in the antenna device component 1 of the first embodiment, the capacitance of each of the first to third capacitors is, for example, set so as to be lower than or equal to 5 pF in a low-frequency band, there is a possibility that the influence of the capacitance (reactance) of each of the first to third capacitors in a high-frequency band may not be ignored. In this case, the first to third capacitors will not be placed in a substantially short-circuit state for signals in a high-frequency band. As a result, the influence of reactance variations of the first to third capacitors in a high-frequency band increases and, therefore, stable characteristics may not be obtained in a high-frequency band. That is, in the antenna device component 1 of the first embodiment, it has been found that inconvenience, such as degradation of matching in a high-frequency band, occurs depending on the capacitance of each of the first to third capacitors. In the present embodiment, the antenna device component that is able to handle the above case will be described.

Configuration of Antenna Device Component

Figure 29:
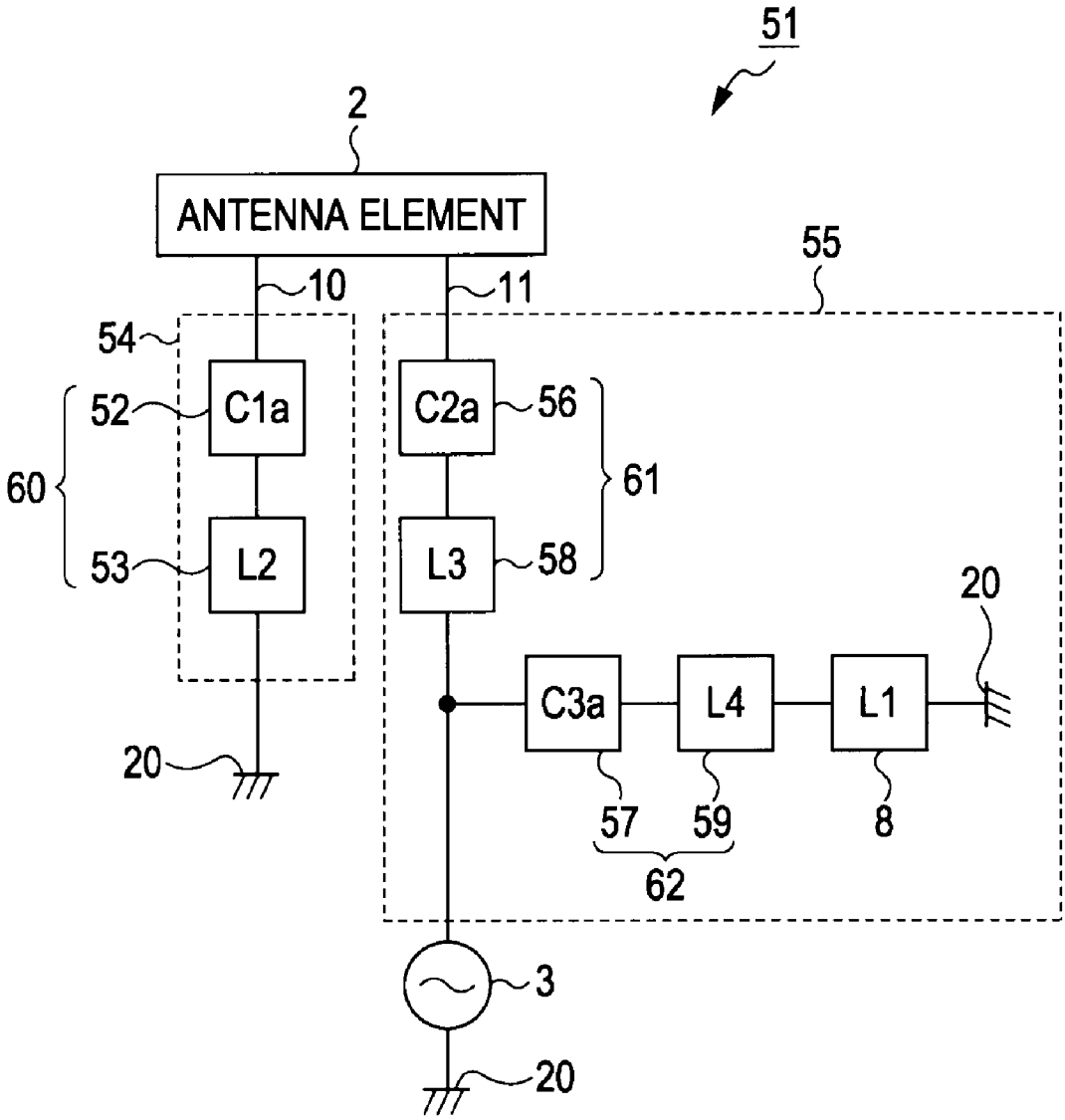
FIG. 29 is a schematic configuration diagram of an antenna device component according to a third embodiment.

The schematic configuration of the antenna device component according to the present embodiment is shown in FIG. 29. Note that the antenna device component of the present embodiment is a single-feeder antenna device component with multiband capability. As shown in FIG. 29, the antenna device component 51 of the present embodiment includes an antenna element 2, a feeding point 3, a first bandwidth adjustment circuit 54, and a second bandwidth adjustment circuit 55.

In the present embodiment, as is apparent from comparison between FIG. 29 and FIG. 3, the configuration of the first and second bandwidth adjustment circuits of the antenna device component is changed from that of the first embodiment shown in FIG. 3. The other configuration is similar to that of the first embodiment. Here, only the first and second bandwidth adjustment circuits will be described, and the description of the other components is omitted.

As shown in FIG. 29, the first bandwidth adjustment circuit 54 of the present embodiment is formed of a series resonant circuit 60 (second resonant circuit) in which a first capacitor 52 having a capacitance of C1*a* and an inductor 53 (hereinafter, also referred to as second inductor 53) having an inductance of L2 are connected in series. In addition, the first capacitor 52 side terminal of the series resonant circuit 60 is connected to the antenna element 2, and the second inductor 53 side terminal is grounded.

In addition, as shown in FIG. 29, the second bandwidth adjustment circuit 55 of the present embodiment includes a series resonant circuit 61 (third resonant circuit) in which a second capacitor 56 having a capacitance of C2*a* and an inductor 58 (hereinafter, also referred to as third inductor 58) having an inductance of L3 are connected in series. In addition, the second bandwidth adjustment circuit 55 includes a series resonant circuit 62 (fourth resonant circuit) in which a third capacitor 57 having a capacitance of C3*a* and an inductor 59 (hereinafter, also referred to as fourth inductor 59) having an inductance of L4 are connected in series, and a first inductor 8 having an inductance of L1.

In the present embodiment, the second capacitor 56 side terminal of the series resonant circuit 61 is connected to the antenna element 2, and the third inductor 58 side terminal is connected to the feeding point 3. In addition, the third capacitor 57 side terminal of the series resonant circuit 62 is connected to the feed line 11 that connects the feeding point 3 to the series resonant circuit 61, and the fourth inductor 59 side terminal is connected to the first inductor 8. Then, a terminal opposite to the series resonant circuit 62 side of the first inductor 8 is grounded.

That is, the antenna device component 51 of the present embodiment is formed so that capacitors included in the antenna device component 1 of the first embodiment are replaced with the series resonant circuits, each of which is formed of a capacitor and an inductor.

In addition, in the series resonant circuits 60 to 62 of the present embodiment, the capacitance of the capacitor and the inductance of the inductors in each of the series resonant circuits are set so that the reactance of each of the series resonant circuits 60 to 62 is 0 at a predetermined frequency in a high-frequency band. Here, as an example, the reactance characteristics of the series resonant circuit 60 (second resonant circuit) in the first bandwidth adjustment circuit 54 are shown in FIG. 30.

Figure 30:
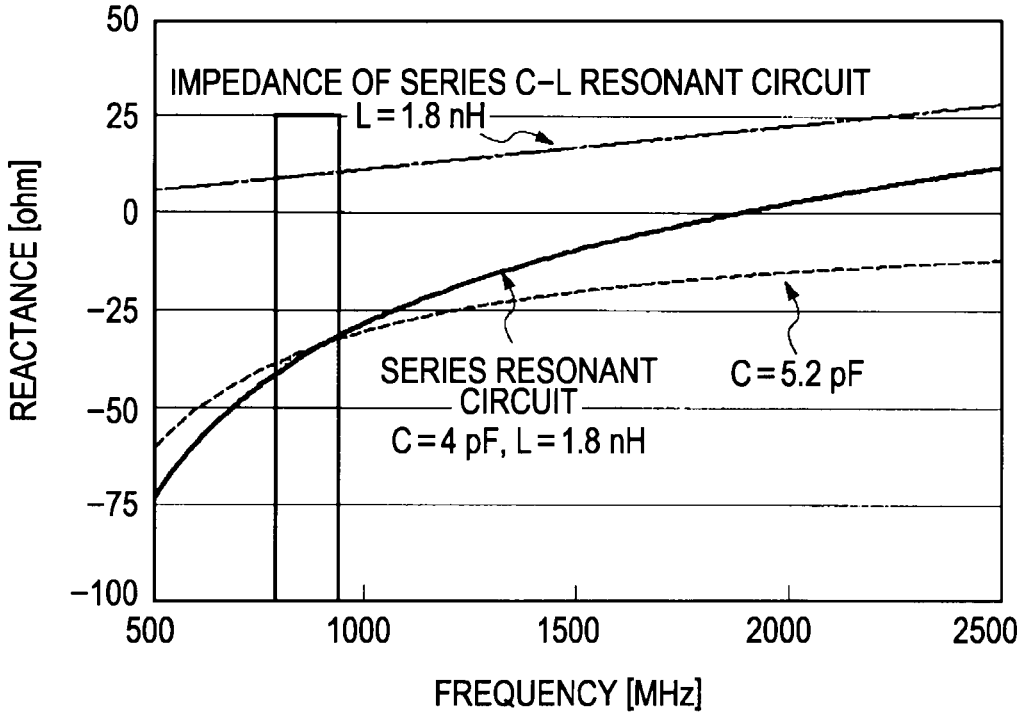
FIG. 30 is the reactance characteristics of a first bandwidth adjustment circuit of the antenna device component according to the third embodiment.

FIG. 30 shows the reactance characteristics in solid line when the capacitance C1*a* of the first capacitor 52 is set at 4 pF and the inductance L2 of the second inductor 53 is set at 1.8 nH. In addition, for comparison, FIG. 30 shows the reactance characteristics of the capacitor having a capacitance of 5.2 pF and the reactance characteristics of the inductor having an inductance of 1.8 nH respectively in broken line and long and short dashed line.

The frequency characteristics (long and short dashed line) of the reactance ($\omega L$) of the inductor has a positive value as shown in FIG. 30. In addition, the frequency characteristics (broken line) of the reactance ($-1/\omega C$) of the capacitor has a negative value as shown in FIG. 30. In contrast, the reactance of the series resonant circuit in which the capacitor and the inductor are connected in series is the sum of the reactance of the capacitor and the reactance of the inductor. Thus, by appropriately adjusting the capacitance of the capacitor and the inductance of the inductor in the series resonant circuit, it is possible to set the reactance of the series resonant circuit at 0 (in a completely short-circuit state) at a specific frequency.

For example, the reactance characteristics of the series resonant circuit 60 formed of the first capacitor 52 having a capacitance C1*a* of 4 pF and the second inductor 53 having an inductance L2 of 1.8 nH have 0 reactance at 1875 MHz as shown in the solid line characteristics in FIG. 30. Thus, when the reactance of the series resonant circuit 60 is 0 at a predetermined frequency in a high-frequency band, the reactance of the series resonant circuit 60 varies around 0 over the entire range of the high-frequency band. In this case, it is possible to reliably place the series resonant circuit 60 in a substantially short-circuit state over the entire range of the high-frequency band. As a result, it is possible to further reduce the variation width of the reactance of the series resonant circuit 60 for signals in a high-frequency band and, therefore, it is possible to further improve matching in a high-frequency band.

In addition, the reactance characteristics (solid line) of the series resonant circuit 60 in a low-frequency band shown in FIG. 30 is almost the same as the reactance characteristics of the capacitor having a capacitance of 5.2 pF in a low-frequency band. Thus, both reactances are equal at 900 MHz. From the above results, it appears that the series resonant circuit 60 formed of the first capacitor 52 having a capacitance C1*a* of 4 pF and the second inductor 53 having an inductance L2 of 1.8 nH has a configuration equivalent to the capacitor having a capacitance of 5.2 pF for signals in a low-frequency band.

Here, frequencies, at which the reactance is 0 when a combination of the capacitance C1*a* of the first capacitor 52 and the inductance L2 of the second inductor 53 is changed, and capacitances C (equivalent capacitance C in Table 1), at which the reactance is equal at 900 MHz, are shown in the following Table 1. Note that the capacitance C1*a* and the inductance L2 in Table 1 are a capacitance and an inductance in a low-frequency band.

TABLE 1

| SERIES RESONANT CIRCUIT | | EQUIVALENT CAPACITANCE C | FREQUENCY [MHz] |
|---|---|---|---|
| C1a[pF] | L2[nH] | [pF] (900 MHz) | (REACTANCE = 0) |
| 1 | 6.8 | 1.3 | 1930 |
| 1.2 | 5.6 | 1.5 | 1940 |
| 1.5 | 4.7 | 1.9 | 1895 |
| 2 | 3.3 | 2.5 | 1960 |
| 2.5 | 2.7 | 3.2 | 1940 |
| 3 | 2.2 | 3.8 | 1960 |
| 3.5 | 2.2 | 4.6 | 1810 |
| 4 | 1.8 | 5.2 | 1875 |

As shown in Table 1, in the present embodiment, even when the capacitance C1*a* of the first capacitor is, for example, set so as to be lower than or equal to 5 pF in a low-frequency band, the reactance may be adjusted to 0 at a predetermined frequency in a high-frequency band. That is, in the present embodiment, even when the capacitance C1*a* of the first capacitor is set so as to be lower than or equal to 5 pF in a low-frequency band, it is possible to reliably place the first bandwidth adjustment circuit 54 in a substantially short-circuit state over the entire range of the high-frequency band.

In addition, even in the series resonant circuits 61 and 62 in the second bandwidth adjustment circuit 55, with the configuration to attain 0 reactance at a predetermined frequency in a high-frequency band, it is possible to obtain similar advantages to those of the above described series resonant circuit 60 of the first bandwidth adjustment circuit 54.

As describe above, in the antenna device component 51 of the present embodiment, even when the capacitance of each of the first to third capacitors is, for example, set so as to be lower than or equal to 5 pF in a low-frequency band, it is possible to stably obtain favorable matching over the entire range of the high-frequency band.

Note that in the present embodiment, the configuration in which all the capacitors in the antenna device component 1 of the first embodiment are replaced with the series resonant circuits, each of which is formed of a capacitor and an inductor, is described; however, the embodiment of the invention is not limited. When among the first to third capacitors in the antenna device component 1 of the first embodiment, only a portion of the capacitors are, for example, set to have a capacitance lower than or equal to 5 pF, only the portion of the capacitors may be replaced with the series resonant circuits.

First Alternative Embodiment

In the above embodiments, the case in which the embodiment of the invention is applied to the existing antenna device component shown in FIG. 35 is described; however, the embodiment of the invention is not limited to them and may be provided for a selected antenna device component having a single mode in a low-frequency band. An example of that is shown in FIG. 31.

Figure 31:
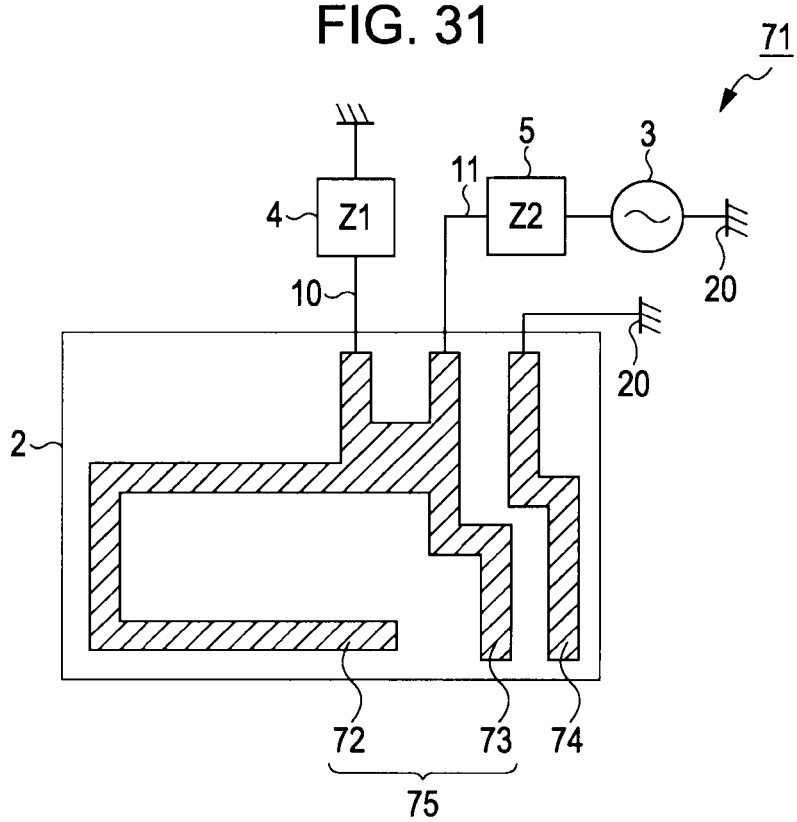
FIG. 31 is a schematic configuration diagram of an antenna device component according to a first alternative embodiment.

In an antenna device component 71 shown in FIG. 31, an antenna element 2 has the same configuration as the antenna element 2 of the existing antenna device component 110 having a short-circuit parasitic element as shown in FIG. 33.

Note that in the antenna device component 71 shown in FIG. 31, the configuration other than the antenna element is similar to that of the antenna device component of any one of the above described embodiments. Here, only the antenna element will be described, and the description of the other configuration is omitted.

As shown in FIG. 31, the antenna element 2 of the antenna device component 71 includes a low-frequency band antenna conductor 72 and two high-frequency band antenna conductors 73 and 74.

The low-frequency band antenna conductor 72 has a path length longer than the first high-frequency band antenna conductor 73 and is electrically connected to the first high-frequency band antenna conductor 73. In addition, the second high-frequency band antenna conductor 74 is formed along the outer side of the first high-frequency band antenna conductor 73, and is not electrically connected to the first high-frequency band antenna conductor 73.

In the antenna device component 71 shown in FIG. 31, the capacitive coupling between the first high-frequency band antenna conductor 73 and the second high-frequency band antenna conductor 74 is utilized to vary a resonance-mode frequency between both the conductors, thus making it possible to handle a plurality of high-frequency band modes.

In addition, in the antenna device component 71 shown in FIG. 31, the first bandwidth adjustment circuit 4 is provided in midway of the short-circuit line 10 that connects the antenna conductor 75, formed of the low-frequency band antenna conductor 72 and the first high-frequency band antenna conductor 73, to the ground point 20. In addition, the second bandwidth adjustment circuit 5 is provided in midway of the feed line 11 that connects the antenna conductor 75 to the feeding point 3.

In the antenna device component 71 shown in FIG. 31, the internal configuration of the first bandwidth adjustment circuit 4 and second bandwidth adjustment circuit 5 is any one of the configurations of the above described first to third embodiments. With the above configuration, as in the case of the first to third embodiments, it is possible to widen the bandwidth of the low-frequency band while maintaining favorable characteristics in a high-frequency band. This is apparent from the above described design principles.

Second Alternative Embodiment

Figure 32:
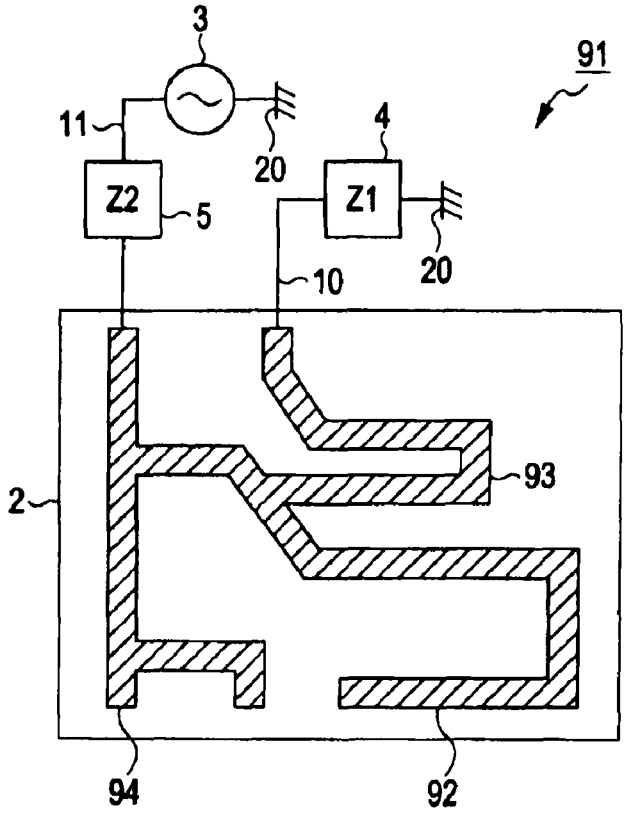
FIG. 32 is a schematic configuration diagram of an antenna device component according to a second alternative embodiment.

In addition, another alternative embodiment is shown in FIG. 32. In the antenna device component 71 shown in FIG. 32, an antenna element 2 has the same configuration as the antenna element 2 of the existing so-called GF slot-type antenna device component 111 shown in FIG. 34. Note that in the antenna device component 91 shown in FIG. 32, the configuration other than the antenna element is similar to the configuration of the antenna device component of any one of the above described embodiments. Here, only the antenna element will be described, and the description of the other configuration is omitted.

The antenna device component 91 shown in FIG. 32 includes the antenna element 2 that has a low-frequency band antenna conductor 92 and two high-frequency band antenna conductors 93 and 94. In addition, these three antenna conductors 92, 93 and 94 are electrically connected to one another. The antenna element 2 is able to handle one low-frequency band mode and a plurality of high-frequency band modes by varying the path length of each of the three antenna conductors 92, 93 and 94.

In the antenna device component 91 shown in FIG. 32, the feed line 11 connects the connecting portion of the antenna conductor 92, 93 and 94 to the feeding point 3. Then, the second bandwidth adjustment circuit 5 is provided in midway of the feed line 11. In addition, one of the terminals of the high-frequency band antenna conductor 93 is grounded by a short-circuit line 10, and a first bandwidth adjustment circuit 4 is provided in midway of the short-circuit line 10.

In the antenna device component 91 shown in FIG. 32, the internal configuration of the first bandwidth adjustment circuit 4 and second bandwidth adjustment circuit 5 is any one of the configurations of the above described first to third embodiments. With the above configuration, as in the case of the first to third embodiments, it is possible to widen the bandwidth of the low-frequency band while maintaining favorable characteristics in a high-frequency band. This is apparent from the above described design principles.

In addition, in the above described embodiments, the embodiment of the invention is applied to the mobile communication terminal as an example; however, the embodiment of the invention is not limited and may be applied to a selected communication terminal equipped with an antenna device component having a single mode in a low-frequency band.

The present application contains subject matter related to that disclosed in Japanese Priority Patent Application JP 2008-125172 filed in the Japan Patent Office on May 12, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna device comprising: an antenna element that transmits or receives wireless signals in a predetermined first frequency band and in a second frequency band that is higher in frequency than the first frequency band;

a feeding terminal portion;

a first bandwidth adjustment circuit that includes a first capacitor for widening a bandwidth of the first frequency band to a predetermined bandwidth, wherein one of terminals of the first capacitor is connected to the antenna element and the other terminal of the first capacitor is directly grounded, wherein the capacitance of the first capacitor is set at a predetermined value in accordance with the predetermined bandwidth, wherein the capacitance of the first capacitor is set at the predetermined value so that the first capacitor is placed in a substantially short-circuit state for signals in the second frequency band; and a second bandwidth adjustment circuit that includes a second capacitor, a third capacitor and a first inductor for widening a bandwidth of the first frequency band to the predetermined bandwidth, wherein one of terminals of the second capacitor is connected to the antenna element and the other terminal of the second capacitor is directly connected to the feeding terminal portion, wherein the third capacitor and the first inductor are connected in series to form a first resonant circuit, wherein one of terminals of the first resonant circuit is connected to the feeding terminal portion and the other terminal of the first resonant circuit is grounded, wherein the capacitance of each of the second and third capacitors and the inductance of the first inductor are respectively set at predetermined values in accordance with the predetermined bandwidth, wherein the capacitance of the second capacitor is set at the predetermined value so that the second capacitor is placed in a substantially short-circuit state for signals in the second frequency band, and wherein the capacitance of the third capacitor and the inductance of the first inductor are respectively set at the predetermined values so that the first resonant circuit is placed in a substantially open state for signals in the second frequency band.

2. The antenna device according to claim 1, wherein the first bandwidth adjustment circuit further includes a second inductor, wherein the second bandwidth adjustment circuit further includes third and fourth inductors, wherein the second inductor and the first capacitor are connected in series to form a second resonant circuit, wherein the third inductor and the second capacitor are connected in series to form a third resonant circuit, wherein the fourth inductor and the third capacitor are connected in series to form a fourth resonant circuit, and wherein the capacitance of each of the first to third capacitors and the inductance of each of the second to fourth inductors are set so that the reactance of each of the second resonant circuit, the third resonant circuit and the fourth resonant circuit is 0 at a predetermined frequency in the second frequency band.

3. The antenna device according to claim 1, wherein the second bandwidth adjustment circuit further includes a fourth capacitor, and wherein the fourth capacitor is connected in parallel with the first resonant circuit.

4. A communication terminal comprising: an antenna element that transmits or receives wireless signals in a predetermined first frequency band and in a second frequency band that is higher in frequency than the first frequency band;

a feeding terminal portion;

a first bandwidth adjustment circuit that includes a first capacitor for widening a bandwidth of the first frequency band to a predetermined bandwidth, wherein one of terminals of the first capacitor is connected to the antenna element and the other terminal of the first capacitor is directly grounded, wherein the capacitance of the first capacitor is set at a predetermined value in accordance with the predetermined bandwidth, wherein the capacitance of the first capacitor is set at the predetermined value so that the first capacitor is placed in a substantially short-circuit state for signals in the second frequency band;

a second bandwidth adjustment circuit that includes a second capacitor, a third capacitor and a first inductor for widening a bandwidth of the first frequency band to the predetermined bandwidth, wherein one of terminals of the second capacitor is connected to the antenna element and the other terminal of the second capacitor is directly connected to the feeding terminal portion, wherein the third capacitor and the first inductor are connected in series to form a first resonant circuit, wherein one of terminals of the first resonant circuit is connected to the feeding terminal portion and the other terminal of the first resonant circuit is grounded, wherein the capacitance of each of the second and third capacitors and the inductance of the first inductor are respectively set at predetermined values in accordance with the predetermined bandwidth, wherein the capacitance of the second capacitor is set at the predetermined value so that the second capacitor is placed in a substantially short-circuit state for signals in the second frequency band, and wherein the capacitance of the third capacitor and the inductance of the first inductor are respectively set at the predetermined values so that the first resonant circuit is placed in a substantially open state for signals in the second frequency band; and a communication circuit that modulates or demodulates the wireless signals transmitted from or received by the antenna element.

* * * * *